US007086333B2

(12) United States Patent
Sampei et al.

(10) Patent No.: US 7,086,333 B2
(45) Date of Patent: Aug. 8, 2006

(54) PRINTING PLATE MATERIAL, PROCESS OF FOLDING THE SAME, AND PRINTING PROCESS

(75) Inventors: Takeshi Sampei, Mitaka (JP); Saburou Hiraoka, Machida (JP)

(73) Assignee: Konica Minolta Holdings, Tokyo (JP)

( * ) Notice: Subject to any disclaimer, the term of this patent is extended or adjusted under 35 U.S.C. 154(b) by 183 days.

(21) Appl. No.: 10/773,470

(22) Filed: Feb. 5, 2004

(65) Prior Publication Data

US 2004/0168598 A1 Sep. 2, 2004

(30) Foreign Application Priority Data

Feb. 13, 2003 (JP) ..... 2003-035001

(51) Int. Cl.
*B41N 1/12* (2006.01)

(52) U.S. Cl. ..... 101/453; 101/384; 101/415.1; 101/462; 101/463.1; 364/320

(58) Field of Classification Search ..... None
See application file for complete search history.

(56) References Cited

U.S. PATENT DOCUMENTS

| | | | | |
|---|---|---|---|---|
| 3,413,706 | A * | 12/1968 | Marchant et al. | 29/407.1 |
| 4,540,612 | A * | 9/1985 | Rhyner | 428/35.2 |
| 4,951,568 | A | 8/1990 | Tsukamoto et al. | |
| 2002/0009574 | A1 | 1/2002 | Hiraoka | |

FOREIGN PATENT DOCUMENTS

| | | |
|---|---|---|
| EP | 04 00 2668 | 12/2004 |
| JP | 05257287 | 10/1993 |
| JP | 2000190456 | 7/2000 |
| JP | 2000258899 | 9/2000 |
| JP | 2001334763 | 12/2001 |

* cited by examiner

*Primary Examiner*—Daniel J. Colilia
*Assistant Examiner*—Jill E. Culler
(74) *Attorney, Agent, or Firm*—Lucas & Merchanti, LLP

(57) ABSTRACT

Disclosed are a printing plate material capable of being folded by heating, a printing process employing the printing plate material and a process of folding the printing plate material, the printing plate material comprising a support and provided thereon, an image formation layer, the support being a polyester sheet with a thickness dispersion of not more then 10%.

20 Claims, 2 Drawing Sheets

PRINTING PLATE MATERIAL, PROCESS OF FOLDING THE SAME, AND PRINTING PROCESS

FIELD OF THE INVENTION

The present invention relates to a printing plate material capable of being folded by heating, which employs a plastic film sheet support, providing high printing durability, good ink receptivity and excellent dimensional stability; a printing process employing the printing plate material; and a process of folding the printing plate material.

BACKGROUND OF THE INVENTION

A metal plate such as an aluminum plate has been used as a support of a printing plate material. However, recently, a printing plate material employing as a support a polyester film sheet has been developed which is easy to handle and carry (see for example, Japanese Patent O.P.I. Publication Nos. 4-261539, 5-257287 and 2000-258899). In the off-set printing press widely used in the printing industry a gripping system (see for example, Japanese Patent O.P.I. Publication No. 3-176152) is well known which folds a printing plate at a specific angle and mounts the printing plate on a plate cylinder of the printing press. This system is designed so as to meet properties of a printing plate employing as a support a metal plate such as an aluminum plate. Accordingly, when the edge portion of a printing plate employing as the support a polyester film sheet being folded at a specific angle, the printing plate is mounted on such a cylinder and printing is carried out, the printing plate has the problem of poor dimensional stability, which results in "out of position", "out of registration" or "out of color registration" during printing. Further, the printing plate has problems in poor ink receptivity at the beginning of printing and poor printing durability.

SUMMARY OF THE INVENTION

An object of the invention is to provide a printing plate material capable of being folded by heating, which employs a plastic film sheet, providing high printing durability, good ink receptivity and excellent dimensional stability; a printing process employing the printing plate material; and a process of folding the printing plate material.

DETAILED DESCRIPTION OF THE INVENTION

Figure 1:
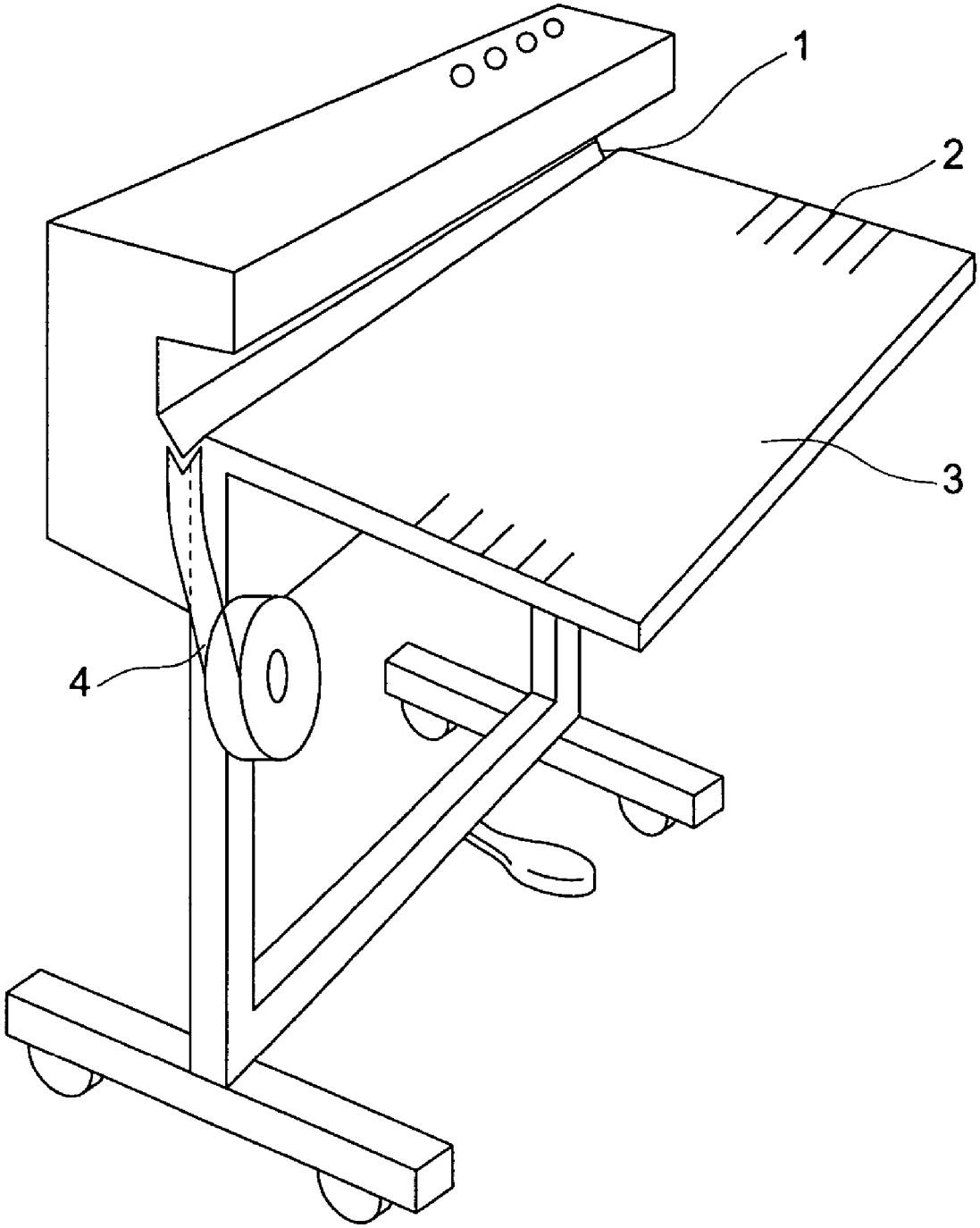
FIG. 1 shows a schematic view of a folding apparatus.

The above object has been attained by one of the following constitutions:

1. A printing plate material comprising a support and provided thereon, an image formation layer, the support being a polyester film sheet with a thickness dispersion of not more than 10%, wherein the printing plate material is capable of being folded by heating.

2. The printing plate material of item 1 above, wherein the support has an average thickness of from 80 to 400 μm.

3. The printing plate material of item 1 above, wherein the image formation layer contains heat melting particles or heat fusible particles.

4. The printing plate material of item 1 above, wherein one or more hydrophilic layers are provided between the support and the image formation layer.

5. The printing plate material of item 4 above, wherein at least one of the hydrophilic layers has a porous structure.

6. The printing plate material of item 1 above, further comprising a layer containing a light-to-heat conversion material.

7. The printing plate material of item 1 above, wherein the support has a water content of not more than 0.5% by weight.

8. A process of printing comprising the steps of:

(a) forming an image on a printing plate material capable of being folded by heating comprising a support and provided thereon, an image formation layer, the support being a polyester film sheet with a thickness dispersion of not more than 10%, and the material being not subjected to wet development;

(b) folding the resulting printing plate material at the edge portion by heating;

(c) mounting the folded printing plate material on a plate cylinder of a printing press; and (d) removing the image formation layer at non-image portions of the printing plate material mounted on the plate cylinder.

9. The process of item 8 above, wherein the image formation is carried out employing a thermal head or a thermal laser.

10. The process of item 8 above, wherein the removing is carried out supplying dampening water and/or printing ink to the printing plate material.

11. The process of item 8 above, wherein the support has an average thickness of from 80 to 400 μm.

12. The process of item 8 above, wherein the image formation layer contains heat melting particles or heat fusible particles.

13. The process of item 8 above, wherein one or more hydrophilic layers are provided between the support and the image formation layer.

14. The process of item 13 above, wherein at least one of the hydrophilic layers has a porous structure.

15. The process of item 8 above, wherein further comprising a layer containing a light-to-heat conversion material.

16. The process of item 8 above, wherein the support has a water content of not more than 0.5% by weight.

17. A process of folding a printing plate material comprising a support and provided thereon, an image formation layer, the support being a polyester film sheet with a thickness dispersion of not more than 10%, the process comprising the step of:

folding the printing plate material at the edge portion by heating.

18. The process of item 16 above, wherein the support has an average thickness of from 80 to 400 μm.

19. The process of item 16 above, wherein the image formation layer contains heat melting particles or heat fusible particles.

20. The process of item 16 above, wherein one or more hydrophilic layers are provided between the support and the image formation layer.

21. The process of item 19 above, wherein at least one of the hydrophilic layers has a porous structure.

22. The process of item 16 above, wherein further comprising a layer containing a light-to-heat conversion material.

23. The process of item 16 above, wherein the support has a water content of not more than 0.5% by weight.

1-1. A printing plate material comprising a support and provided thereon, an image formation layer, the support being a polyester film sheet with a thickness dispersion of not more than 10%, wherein the printing plate material is capable of being folded by heating.

1-2. The printing plate material of item 1-1 above, wherein the support has an average thickness of from 80 to 400 μm.

1-3. The printing plate material of item 1-1 or 1-2 above, wherein the image formation layer contains heat melting particles or heat fusible particles.

1-4. The printing plate material of any one of items 1-1 through 1-3 above, wherein at least one hydrophilic layer is provided between the support and the image formation layer.

1-5. The printing plate material of item 1-4 above, wherein the at least one hydrophilic layer has a porous structure.

1-6. The printing plate material of any one of items 1-1 through 1-5 above, further comprising a layer containing a light-to-heat conversion material.

1-7. The printing plate material of any one of items 1-1 through 1-6 above, wherein the support has a water content of not more than 0.5% by weight.

1-8. A printing process comprising the steps of:

recording an image on the printing plate material of any one of items 1-1 through 1-7;

folding the resulting printing plate material by heating without conducting wet development; and mounting the folded printing plate material on a printing press for printing.

1-9. A printing process comprising the steps of:

recording an image on the printing plate material of any one of items 1-1 through 1-7 above, employing a thermal head or a thermal laser;

folding the resulting printing plate material by heating;

mounting the folded printing plate material on a printing press; and removing non-image portions of the printing plate material on a printing press.

1-10. A process of folding a printing plate material comprising a support and provided thereon, an image formation layer, the support being a polyester film sheet with a thickness dispersion of not more than 10%, the process comprising the steps of:

folding the printing plate material by heating.

1-11. The process of item 1-10 above, wherein the support has an average thickness of from 80 to 400 μm.

1-12. The process of item 1-10 or 1-11 above, wherein the image formation layer contains heat melting particles or heat fusible particles.

1-13. The process of any one of items 1-10 through 1-12 above, wherein one or more hydrophilic layers are provided between the support and the image formation layer.

1-14. The process of item 1-13 above, wherein at least one of the hydrophilic layers has a porous structure.

1-15. The process of any one of items 1-10 through 1-14 above, further comprising a layer containing a light-to-heat conversion material.

1-16. The process of any one of items 1-10 through 1-15 above, wherein the support has a water content of not more than 0.5% by weight.

One of characteristics of the invention is to fold a printing plate material by heating. The process of folding a printing plate by heating will be explained below.

[Process of Folding a Printing Plate by Heating]

It is well known that an offset printing press widely used in the printing industry employs a gripper system whereby a printing plate is folded and mounted on the plate cylinder of the press, as is disclosed in Japanese Patent O.P.I. Publication No. 3-176152. In order to mount a printing plate having a polyester film sheet support on the plate cylinder employing this gripper system, it is necessary to fold the edge portions of the printing plate at a specific angle. In the invention, the printing plate material of the invention is folded by heating.

As processes of folding a printing plate by heating, there are a process in which a printing plate is heated at the portion to be folded before applying pressure; a process in which a printing plate is heated at the portion to be folded while applying pressure; and a process in which a printing plate is heated at the portion to be folded after applying pressure. Typically, there are a process as disclosed in Japanese Patent O.P.I. Publication No. 2-102049, in which a printing plate is folded to form a fold and then the fold is heated; a process as disclosed in Japanese Patent O.P.I. Publication No. 10-235834, in which the portion to be folded of a printing plate is inserted between a first V-shaped groove with a heater and a second groove capable of moving up and down, which has a shape to match the first groove, and heated while applying pressure; a process as disclosed in Japanese Patent O.P.I. Publication No. 2000-190456, in which the portion to be folded of a printing plate is heated by a heater, and then pressurized by an unheated pressure device to fold; and a process as disclosed in Japanese Patent O.P.I. Publication No. 2002-254601, in which a printing plate is folded to form a fold at the portion to be folded, followed by blowing hot air to the fold. In the invention, these processes may be used alone or in combination.

In the invention, when the printing plate material of the invention is folded by heating, it is heated to preferably from 40 to 200° C., and more preferably from 50 to 120° C.

Another one of the characteristics of the invention is to employ, as a support, a polyester film sheet having a thickness dispersion of not more than 10%. A polyester film sheet support will be explained below.

[Polyester Film Sheet Support]

It is necessary that the polyester film sheet in the invention have a thickness dispersion of not more than 10%. The thickness dispersion herein referred to means a value (%) obtained by dividing the difference between the maximum thickness and the minimum thickness by the average thickness and then multiplying the result by 100. The thickness dispersion in the invention is not more than 10%, preferably not more than 8%, and more preferably not more than 6%.

The thickness dispersion of the polyester film sheet is determined according to the following: lines are formed at an interval of 10 cm in both the transverse and longitudinal directions on a 60 cm square polyester film sheet to form 36 small squares. The thicknesses of the 36 small squares are measured, and the average thickness, maximum thickness and minimum thickness are obtained.

The polyester used in the polyester film sheet in the invention is not specifically limited, and contains, as a main component, a dicarboxylic acid unit and a diol unit. There are, for example, polyethylene terephthalate (hereinafter also referred to as PET), and polyethylene naphthalate (hereinafter also referred to as PEN). The polyester is preferably PET, a copolyester comprising a PET component as a main component in an amount of not less than 50% by weight, or a polymer blend comprising PET in an amount of not less than 50% by weight.

PET is a polycondensate of terephthalic acid and ethylene glycol, and PEN is a polycondensate of naphthalene dicarboxylic acid and ethylene glycol. The polyester may be a polycondensate of the dicarboxylic acid and diol, constituting PET or PEN, and one or more kinds of a third component. As the third component, there is a compound capable of forming an eater. As a dicarboxylic acid, there is, for example, terephthalic acid, isophthalic acid, phthalic acid, 2,6-naphthalene dicarboxylic acid, 2,7-naphthalene dicarboxylic acid, diphenylsulfone dicarboxylic acid, diphenylether dicarboxylic acid, diphenylthioether dicarboxylic acid, diphenylketone dicarboxylic acid, diphenylindane dicarboxylic acid, and as a diol, there is, for example, propylene glycol, tetramethylene glycol, cyclohexanedimethanol, 2,2-bis(4-hydroxyphenyl)propane, 2,2-bis(4-hydroxyethoxyphenyl)propane, bis(4-hydroxyphenyl) sulfone, bisphenolfluorene dihydroxyethyl ether, diethylene glycol, hydroquinone, cyclohexane diol. The third component may be a polycarboxylic acid or a polyol, but the content of the polycarboxylic acid or polyol is preferably from 0.001 to 5% by weight based on the weight of polyester.

The intrinsic viscosity of the polyester in the invention is preferably from 0.5 to 0.8. Polyesters having different viscosity may be used as a mixture of two or more kinds thereof.

A manufacturing method of the polyester in the invention is not specifically limited, and the polyester can be manufactured according to a conventional polycondensation method. As the manufacturing method, there is a direct esterification method in which a dicarboxylic acid is directly reacted with a diol by heat application to be esterified while distilling off the extra diol at elevated temperature under reduced pressure, or an ester exchange method.

As catalysts, an ester exchange catalyst ordinarily used in synthesis of polyesters, a polymerization catalyst or a heat-resistant stabilizer can be used. Examples of the ester exchange catalyst include $Ca(OAc)_2$—$H_2O$, $Zn(OAc)_2.2H_2O$, $Mn(OAc)_2.4H_2O$, and $Mg(OAc)_2.4H_2O$. Examples of the polymerization catalyst include $Sb_2O_3$ and $GeO_2$. Examples of the heat-resistant stabilizer include Phosphoric acid, phosphorous acid, $PO(OH)(CH_3)_3$, $PO(OH)(OC_6H_5)_3$, and $P(OC_6H_5)_3$. During synthesis of polyesters, an anti-stain agent, a crystal nucleus agent, a slipping agent, an anti-blocking agent, a UV absorber, a viscosity adjusting agent, a transparentizing agent, an anti-static agent, a pH adjusting agent, a dye or pigment may be added.

The polyester film sheet support used in the invention has a thickness of preferably from 80 to 400 μm, and more preferably 120 to 300 μm.

(Preparation of Support)

In order to obtain an average thickness or thickness dispersion of the support in the invention falling within the range described above, it is preferred that the support is prepared according to the following procedures.

The support in the invention is prepared by a method comprising the steps of melting a thermoplastic resin at a temperature of from the melting point (Tm) to Tm+50° C., filtering the melted resin through a filter, extruding the filtrate from a T-die, and casting it on a casting drum at a glass transition point (Tg)−50° C. to Tg to form an unstretched sheet. As a method to obtain the support with the thickness variation falling within the above-described range, a static electricity application method is preferably used. The unstretched sheet is stretched at from Tg to Tg+50° C. by a stretching magnification of from 2 to 4. As another method to obtain the support with the thickness variation falling within the above-described range, a multi-stretching method is preferably used, in which temperature at a later stretching step is higher than that at a preceding stretching step by preferably 1 to 30° C., and more preferably 2 to 15° C.

The stretching magnification at the preceding stretching step is preferably 0.25 to 0.75 times, and more preferably 0.3 to 0.5 times the stretching magnification at the later stretching step. Thereafter, it is preferred that the stretched sheet is maintained at Tg−30° C. to Tg for 5 to 60 seconds, preferably 10 to 40 seconds, and stretched in the lateral direction at Tg to Tg+50° C. by a stretching magnification of 2.5 to 5. The resulting sheet, while held through a chuck at (Tm−50° C.) to (Tm−5° C.), is heat fixed, where the interval of the chucks in the lateral direction is preferably reduced by more than 0 to 10% (heat relaxation). The heat fixed sheet is cooled, subjected to knurling treatment to give a knurl of 10 to 100 μm at the sheet edge, and wounded around a spool. Thus, a multi-axially stretched film sheet is preferably obtained.

(Heat Treatment of Support)

In the invention, the polyester film sheet after stretched and heat-fixed is preferably subjected to heat treatment in order to stabilize dimension of a printing plate and minimize "out of color registration" during printing. After the sheet has been stretched, heat fixed, cooled, wound around a spool once, and unwound, the sheet is properly heat treated at a separate process as follows.

As the heat treatment methods in the invention, there are a transporting method in which the film sheet is transported while holding the both ends of the sheet with a pin or a clip, a transporting method in which the film sheet is roller transported employing plural transporting rollers, an air transporting method in which the sheet is transported while lifting the sheet by blowing air to the sheet (heated air is blown to one or both sides of the sheet from plural nozzles), a heating method which the sheet is heated by radiation heat from for example, an infrared heater, a heating method in which the sheet is brought into contact with plural heated rollers to heat the sheet, a transporting method in which the sheet hanging down by its own weight is wound around an up-take roller, and a combination thereof.

Tension at heat treatment can be adjusted by controlling torque of an up-take roll and/or a feed-out roll and/or by controlling load applied to the dancer roller provided in the process. When the tension is changed during or after the heat treatment, an intended tension can be obtained by controlling load applied to the dancer roller provided in the step before, during and/or after the heat treatment. When the transporting tension is changed while vibrating the sheet, it is useful to reduce the distance the heated rollers.

In order to reduce dimensional change on heat processing (thermal development), which is carried out later, without inhibiting thermal contraction, it is desirable to lower the transporting tension as much as possible, and lengthen the heat treatment time. The heat treatment temperature is preferably in the range of from Tg+50° C. to Tg+150° C. In this temperature range, the transporting tension is preferably from 5 Pa to 1 MPa, more preferably from 5 Pa to 500 kPa, and most preferably from 5 Pa to 200 kPa, and the heat treatment time is preferably from 30 seconds to 30 minutes, and more preferably from 30 seconds to 15 minutes. The above described temperature range, transporting tension range and heat treatment time range can prevent the support planarity from lowering due to partial thermal contraction difference of the support occurring during heat treatment and prevent scrapes from occurring on the support due to friction between the support and transporting rollers.

In the invention, it is preferred that the heat treatment is carried out at least once, in order to obtain an intended dimensional variation rate. The heat treatment can be optionally carried out two or more times.

In the invention, the heat-treated polyester film sheet is cooled from a temperature of around Tg to room temperature and wound around a spool. During cooling to room temperature from a temperature exceeding Tg, the heat-treated polyester film sheet is preferably cooled at a rate of not less than (−) 5° C./second in order to prevent lowering of flatness of the sheet due to cooling.

In the invention, the heat treatment is preferably carried out after the subbing layer described later has been coated. There is, for example, a method in which the polyester film sheet is inline coated with the subbing layer between the heat fixing step and the cooling step, wound around a spool, and thereafter, the wound sheet is heat fixed or a method in which the heat fixed polyester film sheet, being wound around a spool, is coated with a subbing layer in a separate line to obtain a subbed polyester film sheet, and successively, the subbed film maintained horizontally is heat treated. Further, the same heat treatment as above may be carried out after various functional layers such as a backing layer, a conductive layer, a lubricant layer and a subbing layer have been coated.

In the invention, in order to secure good transportability of the support in an exposure device or in a developing machine, the water content of the support is preferably not more than 0.5 by weight.

(Water Content of Support)

The water content of the support in the invention is D' represented by the following formula:

$$D' \text{ (weight \%)} = (w'/W') \times 100$$

wherein W' represents the weight of the support in the equilibrium state at 25° C. and 60% RH, and w' represents the weight of water contained in the support in the equilibrium state at 25° C. and 60% RH.

The water content of the support is preferably not more than 0.5% by weight, more preferably from 0.01 to 0.5% by weight, and most preferably from 0.01 to 0.3% by weight.

As a method of obtaining a support having a water content of not more than 0.5% by weight, there is (1) a method in which the support is heat treated at not less than 100° C. immediately before an image formation layer or another layer is coated on the support, (2) a method in which an image formation layer or another layer is coated on the support under well-controlled relative humidity, and (3) a method in which the support is heat treated at not less than 100° C. immediately before an image formation layer or another layer is coated on the support, covered with a moisture shielding sheet, and then uncovered. Two or more of these methods may be used in combination.

(Adhesion Increasing Treatment to the Support and Subbing Layer Coating on the Support)

In order to increase adhesion between the support and a coating layer, it is preferred that the surface of the support is subjected to adhesion increasing treatment or is coated with a subbing layer. Examples of the adhesion increasing treatment include corona discharge treatment, flame treatment, plasma treatment and UV light irradiation treatment.

The subbing layer is preferably, more preferably a layer containing gelatin or latex. A conductive layer containing a conductive polymer disclosed in Japanese Patent O.P.I. Publication No. 7-20596, items [0031]-[0073] or a conductive layer containing a metal oxide disclosed in Japanese Patent O.P.I. Publication No. 7-20596, items [0074]-[0081] is preferably provided on the support. The conductive layer may be provided on one side or on both sides of the polyester film sheet support. It is preferred that the conductive layer be provided on the image formation layer side of the support. The conductive layer restrains electrostatic charging, reduces dust deposition on the support, and greatly reduces white spot faults at image portions during printing.

The support in the invention is preferably a polyester film sheet, but may be a composite support in which a plate of a metal (for example, iron, stainless steel or aluminum) or a polyethylene-laminated paper sheet is laminated onto a polyester film sheet. The composite support may be one in which the lamination is carried out before any layer is coated on the support, one in which the lamination is carried out after any layer has been coated on the support, or one in which the lamination is carried out immediately before mounted on a printing press.

(Particles)

Particles having a size of from 0.01 to 10 μm are preferably incorporated in an amount of from 1 to 1000 ppm into the support, in improving handling property.

Herein, the particles may be organic or inorganic material. Examples of the inorganic material include silica described in Swiss Patent 330158, glass powder described in French Patent 296995, and carbonate salts of alkaline earth metals, cadmium or zinc described in British Patent 1173181. Examples of the organic material include starch described in U.S. Pat. No. 2,322,037, starch derivatives described such as in Belgian Patent 625451 and British Patent 981198, polyvinyl alcohol described in JP-B 44-3643, polystyrene or polymethacrylate described in Swiss Patent 330158, polyacrylonitrile described in U.S. Pat. No. 3,079,257 and polycarbonate described in U.S. Pat. No. 3,022,169. The shape of the particles may be in a regular form or irregular form.

(Polyvinylidene Chloride Resin)

One embodiment of the invention to obtain the effects of the invention is a light sensitive planographic printing plate material of the invention comprises a support comprising the plastic film sheet described above and provided thereon, an image formation layer, wherein the support has a layer containing a polyvinylidene chloride resin.

The polyvinylidene chloride resin is preferably a vinylidene chloride copolymer, which contains a vinylidene chloride unit as one of the repeating unit. The content of the vinylidene chloride unit in the copolymer is preferably from 70 to 99.9% by weight, more preferably from 85 to 99% by weight, and most preferably from 90 to 99% by weight.

Examples of a monomer unit other than the vinylidene chloride in the copolymer include a unit from methacrylic acid, acrylic acid, itaconic acid, citraconic acid or their ester, acrylonitrile, methacrylonitrile, methyl acrylate, ethyl acrylate, methyl methacrylate, glycidyl methacrylate, 2-hydroxyethyl methacrylate, vinyl acetate, acrylamide or styrene.

The weight average molecular weight of the copolymer is preferably from 5,000 to 100,000, more preferably from 8,000 to 80,000, and most preferably from 10,000 to 45, 000. The weight average molecular weight can be measured employing a GPC (gel permeation chromatography) apparatus available on the market.

The arrangement of the monomer unit in the copolymer is not specifically limited, and may be random or in the block form.

An aqueous dispersion of the polyvinylidene chloride resin may be latex containing the resin in the form of particles having a uniform composition or latex containing the resin in the form of particles having a core-shell structure in which composition of the core is different from that of the shell.

Examples of the vinylidene chloride copolymer latex are listed below. The copolymerization ratio in the parenthesis is by weight, and Mw is a weight average molecular weight.

A: Vinylidene chloride: methyl acrylate: acrylic acid (90:9:1) latex (Mw=42,000)

B: Vinylidene chloride: methyl acrylate: methyl methacrylate: acrylonitrile: methacrylic acid (87:4:4:4:1) latex (Mw=40,000)

C: Vinylidene chloride: methyl acrylate: glycidyl methacrylate: methacrylic acid (90:6:2:2) latex (Mw=38,000)

D: Vinylidene chloride:ethyl methacrylate: 2-hydroxyethyl methacrylate: acrylic acid (90:8:1.5:0.5) latex (Mw=44,000)

E: Core-shell type latex (core: 70% by weight, shell: 30% by weight)

Core composition: Vinylidene chloride: methyl acrylate: methyl methacrylate: acrylonitrile: methacrylic acid (93:3:3:0.9:0.1)

Shell composition: Vinylidene chloride: methyl acrylate: methyl methacrylate: acrylonitrile: methacrylic acid (88:3:3:3:3) (Mw=38,000)

F: Core-shell type latex (core: 70% by weight, shell: 30% by weight)

Core composition: Vinylidene chloride: methyl acrylate: methyl methacrylate: acrylonitrile: methacrylic acid (92.5:3:3:1:0.5)

Shell composition: Vinylidene chloride: methyl acrylate: methyl methacrylate: acrylonitrile: methacrylic acid (90:3:3:1:3) (Mw=20,000)

(Polyvinylidene Chloride Resin-Containing Layer)

The polyvinylidene chloride resin may be contained in the image formation layer or in the subbing layer, a hydrophilic layer described layer or another layer which is provided on the image formation layer side of the support. It is preferred that the polyvinylidene chloride resin is contained in the subbing layer. The subbing layer may be a single layer or plural layers. The polyvinylidene chloride resin layer has a thickness of preferably from 0.5 to 10 μm. When the polyvinylidene chloride resin layer is provided on each side of the support, each resin layer has a thickness of preferably from 0.8 to 5 μm, and more preferably from 1.0 to 3 μm.

The light sensitive planographic printing plate material of the invention comprises a polyester film sheet support, and provided thereon, an image formation layer, wherein an image capable of being printed is formed on the image formation layer after imagewise exposed or after imagewise exposed and developed. The light sensitive planographic printing plate material of the invention is preferably a planographic printing plate material forming an image according to a silver salt diffusion transfer method disclosed in Japanese Patent O.P.I. Publication No. 4-261539, an ablation type planographic printing plate material forming an image employing a thermal laser or a thermal head, or a silver salt diffusion transfer method disclosed in JP-8-507727 or Japanese Patent O.P.I. Publication No. 6-186750, a heat melt image layer on-press development type planographic printing plate material or a heat fusible transfer type planographic printing plate material disclosed in Japanese Patent O.P.I. Publication No. 9-123387. Among these, an ablation type planographic printing plate material, a heat melt image layer on-press development type planographic printing plate material or a heat fusible transfer type planographic printing plate material, each being a processless CTP printing plate material, is preferred since load to environment is reduced. The planographic printing plate material is preferred which comprises the polyester film sheet support and provided thereon, an image formation layer containing heat melt particles or heat fusible particles.

[Image Formation Layer]

The image formation layer in the invention preferably contains heat melting particles and/or heat fusible particles.

(Heat Melting Particles)

The heat melting particles used in the invention are particularly particles having a low melt viscosity, or particles formed from materials generally classified into wax. The materials preferably have a softening point of from 40° C. to 120° C. and a melting point of from 60° C. to 150° C., and more preferably a softening point of from 40° C. to 100° C. and a melting point of from 60° C. to 120° C. The melting point less than 60° C. has a problem in storage stability and the melting point exceeding 300° C. lowers ink receptive sensitivity.

Materials usable include paraffin, polyolefin, polyethylene wax, microcrystalline wax, and fatty acid wax. The molecular weight thereof is approximately from 800 to 10,000. A polar group such as a hydroxyl group, an ester group, a carboxyl group, an aldehyde group and a peroxide group may be introduced into the wax by oxidation to increase the emulsification ability. Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and a copolymer of these resins may also be usable.

Among them, polyethylene, microcrystalline wax, fatty acid ester and fatty acid are preferably contained. A high sensitive image formation can be performed since these materials each have a relative low melting point and a low melt viscosity. These materials each have a lubrication ability. Accordingly, even when a shearing force is applied to the surface layer of the printing plate precursor, the layer damage is minimized, and resistance to contaminations which may be caused by scratch is further enhanced.

The heat melting particles are preferably dispersible in water. The average particle size thereof is preferably from 0.01 to 10 μm, and more preferably from 0.05 to 3 μm. When a layer containing the heat melting particles is coated on a porous hydrophilic layer described later, the particles having an average particle size less than 0.01 μm may enter the pores of the hydrophilic layer or the valleys between the neighboring two peaks on the hydrophilic layer surface, resulting in insufficient on press development and background contaminations. The particles having an average particle size exceeding 10 μm may result in lowering of dissolving power.

The composition of the heat melting particles may be continuously varied from the interior to the surface of the particles. The particles may be covered with a different material. Known microcapsule production method or sol-gel method can be applied for covering the particles. The heat melting particle content of the layer is preferably 1 to 90% by weight, and more preferably 5 to 80% by weight based on the total layer weight.

(Heat Fusible Particles)

The heat fusible particles in the invention include thermoplastic hydrophobic polymer particles. Although there is no specific limitation to the upper limit of the softening point of the thermoplastic hydrophobic polymer particles, the softening point is preferably lower than the decomposition temperature of the polymer particles. The weight average molecular weight (Mw) of the polymer is preferably within the range of from 10,000 to 1,000,000.

Examples of the polymer consistituting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co) polymer or a (meth)acrylic acid (co)polymer such as polymethyl methacrylate, a methyl methacrylate-(2-ethylhexyl) acrylate copolymer, a methyl methacrylate-methacrylic acid copolymer, or a methyl acrylate-(N-methylolacrylamide); polyacrylonitrile; a vinyl ester (co)polymer such as a polyvinyl acetate, a vinyl acetate-vinyl propionate copolymer and a vinyl acetate-ethylene copolymer, or a vinyl acetate-2-hexylethyl acrylate copolymer; and polyvinyl chloride, polyvinylidene chloride, polystyrene and a copolymer thereof. Among them, the (meth)acrylate polymer, the (meth)acrylic acid (co)polymer, the vinyl ester (co)polymer, the polystyrene and the synthetic rubbers are preferably used.

The polymer particles may be prepared from a polymer synthesized by any known method such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and a method in which the polymer is dissolved in a water-immiscible solvent, then the resulting solution is dispersed in water or an aqueous medium and the solvent is removed by distillation. In both of the methods, a surfactant such as sodium lauryl sulfate, sodium dodecylbenzenesulfate or polyethylene glycol, or a water-soluble resin such as poly(vinyl alcohol) may be optionally used as a dispersing agent or stabilizing agent.

The heat fusible particles are preferably dispersible in water. The average particle size of the heat fusible particles is preferably from 0.01 to 10 μm, and more preferably from 0.1 to 3 μm. When a layer containing the heat fusible particles having an average particle size less than 0.01 μm is coated on the porous hydrophilic layer, the particles may enter the pores of the hydrophilic layer or the valleys between the neighboring two peaks on the hydrophilic layer surface, resulting in insufficient on press development and background contaminations. The heat fusible particles having an average particle size exceeding 10 μm may result in lowering of dissolving power.

Further, the composition of the heat fusible particles may be continuously varied from the interior to the surface of the particles. The particles may be covered with a different material. As a covering method, known methods such as a microcapsule method and a sol-gel method are usable. The heat fusible particle content of the layer is preferably from 1 to 90% by weight, and more preferably from 5 to 80% by weight based on the total weight of the layer.

It is preferred that the image formation layer in the invention contains a light-to-heat conversion material.

The dry coating amount of the image formation layer is preferably from 0.10 to 1.50 g/m$^2$, and more preferably from 0.15 to 1.00 g/m$^2$.

[Hydrophilic Layer]

In the invention, the printing plate material comprises at least one hydrophilic layer between the support and the image formation layer. Next, the hydrophilic layer in the invention, which is provided between the support and the image formation layer, will be explained. The hydrophilic layer is defined as a layer exhibiting high repellency to ink and high affinity to water in the printing plate material.

In the printing plate material of the invention, at least one hydrophilic layer provided on the support preferably has a porous structure. In order to form the hydrophilic layer having such a porous structure, materials described later forming a hydrophilic matrix phase are used.

(Metal Oxide)

Material for forming a hydrophilic matrix phase is preferably a metal oxide. The metal oxide preferably comprises metal oxide particles. Examples of the metal oxide particles include particles of colloidal silica, alumina sol, titania sol and another metal oxide sol. The metal oxide particles may have any shape such as spherical, needle-like, and feather-like shape. The average particle size is preferably from 3 to 100 nm, and plural kinds of metal oxide each having a different size may be used in combination. The surface of the particles may be subjected to surface treatment.

The metal oxide particles can be used as a binder, utilizing its layer forming ability. The metal oxide particles are suitably used in a hydrophilic layer since they minimize lowering of the hydrophilicity of the layer as compared with an organic compound binder.

(Colloidal Silica)

Among the above-mentioned, colloidal silica is particularly preferred. The colloidal silica has a high layer forming ability under a drying condition with a relative low temperature, and can provide a good layer strength. It is preferred that the colloidal silica used in the invention is necklace-shaped colloidal silica or colloidal silica particles having an average particle size of not more than 20 nm, each being described later. Further, it is preferred that the colloidal silica provides an alkaline colloidal silica solution as a colloid solution.

The necklace-shaped colloidal silica to be used in the invention is a generic term of an aqueous dispersion system of a spherical silica having a primary particle size of the order of nm. The necklace-shaped colloidal silica to be used in the invention means a "pearl necklace-shaped" colloidal silica formed by connecting spherical colloidal silica particles each having a primary particle size of from 10 to 50 μm so as to attain a length of from 50 to 400 nm.

The term of "pearl necklace-shaped" means that the image of connected colloidal silica particles is like to the shape of a pearl necklace. The bonding between the silica particles forming the necklace-shaped colloidal silica is considered to be —Si—O—S—, which is formed by dehydration of. —SIOH groups located on the surface of the silica particles. Concrete examples of the necklace-shaped colloidal silica include Snowtex-PS series produced by Nissan Kagaku Kogyb, Co., Ltd. As the products, there are Snowtex-PS-S (the average particle size in the connected state is approximately 110 nm), Snowtex-PS-M (the average particle size in the connected state is approximately 120 nm) and Snowtex-PS-L (the average particle size in the connected state is approximately 170 nm). Acidic colloidal silicas corresponding to each of the above-mentioned are Snowtex-PS-S-O, Snowtex-PS-M-O and Snowtex-PS-L-O, respectively.

The necklace-shaped colloidal silica is preferably used in a hydrophilic layer as a porosity providing material for hydrophilic matrix phase, and porosity and strength of the layer can be secured by its addition to the layer. Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

It is known that the binding force of the colloidal silica particles is become larger with decrease of the particle size. The average particle size of the colloidal silica particles to be used in the invention is preferably not more than 20 nm, and more preferably 3 to 15 nm. As above-mentioned, the alkaline colloidal silica particles show the effect of inhibiting occurrence of the background contamination. Accordingly, the use of the alkaline colloidal silica particles is particularly preferable. Examples of the alkaline colloidal silica particles having the average particle size within the foregoing range include Snowtex-20 (average particle size: 10 to 20 nm), Snowtex-30 (average particle size: 10 to 20 nm), Snowtex-40 (average particle size: 10 to 20 nm), Snowtex-N (average particle size: 10 to 20 nm), Snowtex-S (average particle size: 8 to 11 nm) and Snowtex-XS (average particle size: 4 to 6 nm), each produced by Nissan Kagaku Co., Ltd.

The colloidal silica particles having an average particle size of not more than 20 nm, when used together with the necklace-shaped colloidal silica as described above, is particularly preferred, since porosity of the layer is maintained and the layer strength is further increased.

The ratio of the colloidal silica particles having an average particle size of not more than 20 nm to the necklace-shaped colloidal silica is preferably from 95/5 to 5/95, more preferably from 70/30 to 20/80, and most preferably from 60/40 to 30/70.

(Porous Metal Oxide Particles)

The hydrophilic layer of the printing plate precursor of the invention contains porous metal oxide particles as metal oxides. Examples of the porous metal oxide particles include porous silica particles, porous aluminosilicate particles or zeolite particles as described later.

<Porous Silica or Porous Aluminosilicate Particles>

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle size of such particles can be controlled by variation of the production conditions. The porous silica particles prepared from the gel by the wet method is particularly preferred.

The porous aluminosilicate particles can be prepared by the method described in, for example, JP O.P.I. No. 10-71764. Thus prepared aluminosilicate particles are amorphous complex particles synthesized by hydrolysis of aluminum alkoxide and silicon alkoxide as the major components. The particles can be synthesized so that the ratio of alumina to silica in the particles is within the range of from 1:4 to 4:1. Complex particles composed of three or more components prepared by an addition of another metal alkoxide may also be used in the invention. In such a particle, the porosity and the particle size can be controlled by adjustment of the production conditions.

The porosity of the particles is preferably not less than 1.0 ml/g, more preferably not less than 1.2 ml/g, and most preferably of from 1.8 to 2.5 ml/g, in terms of pore volume. The pore volume is closely related to water retention of the coated layer. As the pore volume increases, the water retention is increased, contamination is difficult to occur, and the water retention latitude is broad. Particles having a pore volume of more than 2.5 ml/g are brittle, resulting in lowering of durability of the layer containing them. Particles having a pore volume of less than 0.5 ml/g may be insufficient in printing performance.

(Measurement of Pore Volume)

Measurement of the pore volume is carried out employing AUTOSORB-1 produced by Quantachrome Co., Ltd. Assuming that the voids of particles are filled with a nitrogen gas, the pore volume is calculated from a nitrogen gas adsorption amount at a relative pressure of 0.998.

(Zeolite Particles)

Zeolite is a crystalline aluminosilicate, which is a porous material having voids of a regular three dimensional net work structure and having a pore size of 0.3 to 1 nm. Natural and synthetic zeolites are expressed by the following formula.

$$(M_1.(M_2)_{0.5})_m(Al_mSi_nO_{2(m+n)}).xH_2O$$

In the above, $M_1$ and $M_2$ are each exchangeable cations. Examples of $M_1$ include $Li^+$, $Na^+$, $K^+$, $Tl^+$, $Me_4N^+$ (TMA), $Et_4N^+$ (TEA), $Pr_4N^+$ (TPA), $C_7H_{15}N^{2+}$, and $C_8H_{16}N^+$, and examples of $M^2$ include $Ca^{2+}$, $Mg^{2+}$, $Ba^{2+}$, $Sr^{2+}$ and $C_8H_{18}N_2$ 2+. Relation of n and m is n≧m, and consequently, the ratio of m/n, or that of Al/Si is not more than 1. A higher Al/Si ratio shows a higher content of the exchangeable cation, and a higher polarity, resulting in higher hydrophilicity. The Al/Si ratio is within the range of preferably from 0.4 to 1.0, and more preferably 0.8 to 1.0. x is an integer.

Synthetic zeolite having a stable Al/Si ratio and a sharp particle size distribution is preferably used as the zeolite particles to be used in the invention. Examples of such zeolite include Zeolite A: $Na_{12}(Al_{12}Si_{12}O_{48}).27H_2O$; Al/Si=1.0, Zeolite X: $Na_{86}(Al_{86}Si_{106}O_{384}).264H_2O$; Al/Si=0.811, and Zeolite Y: $Na_{56}(Al_{56}Si_{136}O_{384}).250H_2O$; Al/Si=0.412.

Containing the porous zeolite particles having an Al/Si ratio within the range of from 0.4 to 1.0 in the hydrophilic layer greatly raises the hydrophilicity of the hydrophilic layer itself, whereby contamination in the course of printing is inhibited and the water retention latitude is also increased. Further, contamination caused by a finger mark is also greatly reduced. When Al/Si is less than 0.4, the hydrophilicity is insufficient and the above-mentioned improving effects are lowered.

The hydrophilic matrix phase constituting the hydrophilic layer in the invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. Among them, ones having a higher electric charge density of the unit layer are higher in the polarity and in the hydrophilicity. Preferable charge density is not less than 0.25, more preferably not less than 0.6. Examples of the layer structural mineral particles having such a charge density include smectite having a negative charge density of from 0.25 to 0.6 and bermiculite having a negative charge density of from 0.6 to 0.9. Synthesized fluorinated mica is preferable since one having a stable quality, such as the particle size, is available. Among the synthesized fluorinated mica, swellable one is preferable and one freely swellable is more preferable.

An intercalation compound of the foregoing layer structural mineral particles such as a pillared crystal, or one treated by an ion exchange treatment or a surface treatment such as a silane coupling treatment or a complication treatment with an organic binder is also usable.

With respect to the size of the planar structural mineral particles, the particles have an average particle size (an average of the largest particle length) of preferably not more than 20 μm, and more preferably not more than 10 μm, and an average aspect ratio (the largest particle length/the particle thickness of preferably not less than 20, and more preferably not less than 50, in a state contained in the layer including the case that the particles are subjected to a swelling process and a dispersing layer-separation process. When the particle size is within the foregoing range, continuity to the parallel direction, which is a trait of the layer structural particle, and softness, are given to the coated layer so that a strong dry layer in which a crack is difficult to be formed can be obtained. The coating solution containing the layer structural clay mineral particles in a large amount can minimize particle sedimentation due to a viscosity increasing effect. The particle size greater than the foregoing may produce a non-uniform coated layer, resulting in poor layer strength. The aspect ratio lower than the foregoing reduces the planar particles, resulting in insufficient viscosity increase and reduction of particle sedimentation inhibiting effect.

The content of the layer structural clay mineral particles is preferably from 0.1 to 30% by weight, and more preferably from 1 to 10% by weight based on the total weight of the layer. Particularly, the addition of the swellable synthesized fluorinated mica or smectite is effective if the adding amount is small. The layer structural clay mineral particles may be added in the form of powder to a coating liquid, but it is preferred that gel of the particles which is obtained by being swelled in water, is added to the coating liquid in order to obtain a good dispersity according to an easy coating liquid preparation method which requires no dispersion process comprising dispersion due to media.

An aqueous solution of a silicate is also usable as another additive to the hydrophilic matrix phase. An alkali metal silicate such as sodium silicate, potassium silicate or lithium silicate is preferable, and the $SiO_2/M_2O$ is preferably selected so that the pH value of the coating liquid after addition of the silicate exceeds 13 in order to prevent dissolution of the porous metal oxide particles or the colloidal silica particles.

An inorganic polymer or an inorganic-organic hybrid polymer prepared by a sol-gel method employing a metal alkoxide. Known methods described in S. Sakka "Application of Sol-Gel Method" or in the publications cited in the above publication can be applied to prepare the inorganic polymer or the inorganic-organic hybridpolymer by the sol-gel method.

A water soluble resin may be contained in the hydrophilic layer in the invention. Examples of the water soluble resin include polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone. In the invention, polysaccharides are preferably used as the water soluble resin.

As the polysaccharide, starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable. These polysaccharides can form a preferred surface shape of the hydrophilic layer.

The surface of the hydrophilic layer preferably has a convexoconcave structure having a pitch of from 0.1 to 50 μm such as the grained aluminum surface of an aluminum PS plate. The water retention ability and the image maintaining ability are raised by such a convexoconcave structure of the surface. Such a convexoconcave structure can also be formed by adding in an appropriate amount a filler having a suitable particle size to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the adding amount of the water-soluble polysaccharide, the kinds and the adding amount of another additive, a solid concentration of the coating liquid, a wet layer thickness or a drying condition.

In the invention, it is preferred that the water soluble resin contained in the hydrophilic matrix phase is water soluble, and at least a part of the resin exists in the hydrophilic layer in a state capable of being dissolved in water. If a water soluble carbon atom-containing material is cross-linked by a crosslinking agent and is insoluble in water, its hydrophilicity is lowered, resulting in problem of lowering printing performance. A cationic resin may also be contained in the hydrophilic layer. Examples of the cationic resin include a polyalkylene-polyamine such as a polyethyleneamine or polypropylenepolyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

A water-soluble surfactant may be added for improving the coating ability of the coating liquid for the hydrophilic layer in the invention. A silicon atom-containing surfactant and a fluorine atom-containing surfactant are preferably used. The silicon atom-containing surfactant is especially preferred in that it minimizes printing contamination. The content of the surfactant is preferably from 0.01 to 3% by weight, and more preferably from 0.03 to 1% by weight based on the total weight of the hydrophilic layer (or the solid content of the coating liquid).

The hydrophilic layer in the invention can contain a phosphate. Since a coating liquid for the hydrophilic layer is preferably alkaline, the phosphate to be added to the hydrophilic layer is preferably sodium phosphate or sodium monohydrogen phosphate. The addition of the phosphate provides improved reproduction of dots at shadow portions. The content of the phosphate is preferably from 0.1 to 5% by weight, and more preferably from 0.5 to 2% by weight in terms of amount excluding hydrated water.

The hydrophilic layer in the invention can contain a light heat conversion material as described later. When the material is in the particle form, the particle size is preferably less than 1 μm.

<Inorganic Particles or Inorganic Material Coated Particles Both Having a Particle Size not Less than 1 μm>

Examples of the inorganic particles include well-known metal oxide particles include particles of silica, alumina, titania and zirconia. Porous metal oxide particles are preferably used in order to prevent sedimentation of the particles in a coating liquid. Examples of the porous metal oxide particles include the porous silica particles and the porous aluminosilicate particles described above.

The inorganic material coated particles include particles in which organic particles such as polymethyl methacrylate particles or polystyrene particles form cores and the cores are covered with inorganic particles having a size smaller than that of the cores. The particle size of the inorganic particles is preferably from 1/10 to 1/100 of that of the cores. Further, well-known metal oxide particles include particles of silica, alumina, titania and zirconia can be used as the inorganic particles. There are various covering methods, but a dry covering method is preferred in which the cores collide with the covering materials at high speed in air as in a hybridizer for the covering materials to penetrate the surface of the cores and fix them there.

Particles in which organic particles are plated with a metal can be used. Examples of such particles include Micropearl AU produced by Sekisui Kagaku Co., Ltd., in which resin particles are plated with a metal.

It is necessary that the particles have a particle size of not less than 1 μm, and satisfy inequality (1) described previously. The particle size is more preferably from 1 to 10 μm, still more preferably from 1.5 to 8 μm, and most preferably from 2 to 6 μm.

When the particle size exceeds 10 μm, it may lower dissolution of formed images or result in contamination of blanket during printing. In the invention, the content of the particles having a particle size of not less than 1 μm in the hydrophilic layer is suitably adjusted to satisfy the parameters regarding the invention, but is preferably from 1 to 50% by weight, and more preferably from 5 to 40% by weight, based on the hydrophilic layer. The content of materials containing a carbon atom such as the organic resins or carbon black in the hydrophilic layer is preferably lower in increasing hydrophilicity of the hydrophilic layer. The total content of these materials in the hydrophilic layer is preferably less than 9% by weight, and more preferably less than 5% by weight.

[Hydrophilic Overcoat Layer]

In the invention, a hydrophilic overcoat layer is preferably provided on the image formation layer, in order to prevent flaws from occurring during handling. The hydrophilic overcoat layer may be provided directly or through an intermediate layer on the image formation layer. It is preferred that the hydrophilic overcoat layer can be removed on a printing press.

In the invention, it is preferred that the hydrophilic overcoat layer contains a water soluble resin or a water swellable resin in which a water soluble resin is partly cross-linked. Examples of the water soluble resin include those used in the hydrophilic layer described above.

In the invention, the hydrophilic overcoat layer can contains a light-to-heat conversion material described later.

The overcoat layer in the invention preferably contains a matting agent with an average size of from 1 to 20 μm, in order to prevent flaws from occurring while the printing plate material is mounted on a laser apparatus or on a printing press.

The matting agent is preferably inorganic particles having a new Mohs hardness of not less than 5 or an organic matting agent. Examples of the inorganic particles having a new Mohs hardness of not less than 5 include particles of metal oxides (for example, silica, alumina, titania, zirconia, iron oxides, chromium oxide), particles of metal carbides (for example, silicon carbide), boron nitride particles, and diamond particles. Examples of the organic matting agent include starch described in U.S. Pat. No. 2,322,037, starch derivatives described in BE 625,451 and GB 981,198, Polyvinyl alcohol described in JP-B-44-3643, polystyrene or polymethacrylate described in CH 330,158, polyacrylonitrile described in U.S. Pat. No. 3,079,257, and polycarbonate described in U.S. Pat. No. 3,022,169.

The adding amount of the matting agent in the overcoat layer is preferably from 0.1 g to less than 10 g per $m^2$.

A coating solution for the overcoat layer may contain a nonionic surfactant in order to secure uniform coatability of the overcoat layer. Examples of the nonionic surfactant include sorbitan tristearate, sorbitan monopalmitate, sorbitan trioleate, stearic acid monoglyceride, polyoxyethylenenonylphenyl ether, and polyoxyethylenedodecyl ether. The content of the nonionic surfactant is preferably 0.05 to 5% by weight, and more preferably 1 to 3% by weight based on the total solid content of the overcoat layer.

In the invention, the dry thickness of the overcoat layer is preferably 0.05 to 1.5 $g/m^2$, and more preferably 0.1 to 0.7 $g/m^2$. This content range prevents occurrence of staining or scratches or deposition of fingerprints, and minimizes ablation scum without impairing removability of the overcoat layer.

[Light-To-Heat Conversion Material]

The image formation layer, hydrophilic layer, hydrophilic overcoat layer or another layer in the invention can contain a light heat conversion material.

Examples of the light heat conversion material include the following substances:

(Infrared Absorbing Dye)

Examples of the light-heat conversion material include a general infrared absorbing dye such as a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound or an indoaniline compound. Exemplarily, the light-heat conversion materials include compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds may be used singly or in combination.

Examples of pigment include carbon, graphite, a metal and a metal oxide. Furnace black and acetylene black is preferably used as the carbon. The graininess ($d_{50}$) thereof is preferably not more than 100 nm, and more preferably not more than 50 nm.

The graphite is one having a particle size of preferably not more than 0.5 μm, more preferably not more than 100 nm, and most preferably not more than 50 nm.

As the metal, any metal can be used as long as the metal is in a form of fine particles having preferably a particle size of not more than 0.5 μm, more preferably not more than 100 nm, and most preferably not more than 50 nm. The metal may have any shape such as spherical, flaky and needle-like. Colloidal metal particles such as those of silver or gold are particularly preferred.

As the metal oxide, materials having black color in the visible regions, or electro-conductive materials or semiconductive materials can be used. Examples of the materials having black color in the visible regions include black iron oxide ($Fe_3O_4$), and black complex metal oxides containing at least two metals. Black complex metal oxides comprised of at least two metals are preferred. Typically, the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441. The complex metal oxide used in the invention is preferably a complex Cu—Cr—Mn type metal oxide or a Cu—Fe—Mn type metal oxide. The Cu—Cr—Mn type metal oxides are preferably subjected to the treatment disclosed in Japanese Patent O.P.I. Publication Nos. 8-27393 in order to reduce isolation of a 6-valent chromium ion. These complex metal oxides have a high color density and a high light heat conversion efficiency as compared with another metal oxide. The primary average particle size of these complex metal oxides is preferably from 0.001 to 1.0 μm, and more preferably from 0.01 to 0.5 μm. The primary average particle size of from 0.001 to 1.0 μm improves a light heat conversion efficiency relative to the addition amount of the particles, and the primary average particle size of from 0.05 to 0.5 μm further improves a light heat conversion efficiency relative to the addition amount of the particles. The light heat conversion efficiency relative to the addition amount of the particles depends on a dispersity of the particles, and the well-dispersed particles have a high light heat conversion efficiency. Accordingly, these complex metal oxide particles are preferably dispersed according to a known dispersing method, separately to a dispersion liquid (paste), before being added to a coating liquid for the particle containing layer. The metal oxides having a primary average particle size of less than 0.001 are not preferred since they are difficult to disperse. A dispersant is optionally used for dispersion. The addition amount of the dispersant is preferably from 0.01 to 5% by weight, and more preferably from 0.1 to 2% by weight, based on the weight of the complex metal oxide particles. Kinds of the dispersant are not specifically limited, but the dispersant is preferably a silicon-contained surfactant.

Examples of the electro-conductive materials or semiconductive materials include Sb-doped $SnO_2$ (ATO), Sn-added $In_2O_3$ (ITO), $TiO_2$, TiO prepared by reducing $TiO_2$ (titanium oxide nitride, generally titanium black). Particles prepared by covering a core material such as $BaSO_4$, $TiO_2$, $9Al_2O_3.2B_2O$ and $K_2O.nTiO_2$ with these metal oxides is usable. The particle size of these particles is preferably not more than 0.5 μm, more preferably not more than 100 nm, and most preferably not more than 50 nm.

The especially preferred light heat conversion materials are the above-described infrared absorbing dyes or the black complex metal oxides comprised of at least two metal oxides.

The addition amount of the light heat conversion materials is preferably 0.1 to 50% by weight, more preferably 1 to 30% by weight, and most preferably 3 to 25% by weight based on the weight of the layer to which the material are added.

[Visibility]

Before a printing plate with an image is mounted on a printing press for printing, there is usually a plate inspection process for examining if the image is correctly formed on the printing plate. When the plate inspection process is carried out, it is preferred that a printing plate before printing has a property in which an image formed on the printing plate is visible, that is, image visibility. Since the printing plate material of the invention is a processless printing plate material capable of carrying out printing without special development, it is preferred that the optical density of exposed portions in the printing plate material varies by light or heat generated on exposure.

As a method for providing image visibility to a printing plate material in the invention, there is a method employing a cyanine type infrared light absorbing dye, which varies its optical density on exposure, a method employing a combination of a photo-induced acid generating agent and a compound varying its color by an acid, or a method employing a combination of a color forming agent such as a leuco dye and a color developing agent.

In the invention, a photo-induced acid generating agent is a compound producing a Lewis acid or a Broensted acid on light exposure. Examples thereof include a diazonium compound, an orthoquinonediazide compound, a polyhalogenated compound, an onium salt, and a polymer having a unit derived from them.

Examples of the diazonium compound include a condensation product of a diphenylamine-p-diazonium salt and formaldehyde, which is a reaction product of a diazonium compound disclosed in U.S. Pat. Nos. 2,063,631 and 2,667,415 with a reactive carbonyl group-containing compound such as aldol or acetal, a salt of the diazonium salt having as an anion a halogen-containing Lewis acid anion such as $BF_4^-$ or $PF_6^-$, and an aryldiazonium salt.

Examples of the orthoquinonediazide compound include a compound having at least one quinonediazide group in one molecule such as 1,2-naphthoquinone-2-diazide-5-sulfonic acid ethyl ester, 1,2-naphthoquinone-2-diazide-5-sulfonic acid isobutyl ester, 1,2-naphthoquinone-2-diazide-5-sulfonic acid phenyl ester, 1,2-naphthoquinone-2-diazide-5-sulfonic acid α-naphthyl ester, 1,2-naphthoquinone-2-diazide-5-sulfonic acid benzyl ester, 1,2-naphthoquinone-2-diazide-4-sulfonic acid phenyl ester, N-ethyl-1,2-naphthoquinone-2-diazide-4-sulfonic acid amide, and N-phenyl-1,2-naphthoquinone-2-diazide-4-sulfonic acid amide.

Examples of the polyhalogenated compound include an acetophenone containing plural halogens such as tribromoacetophenone, trichloroacetophenone, o-nitro-tribromoacetophenone, p-nitro-tribromoacetophenone, m-nitro-tribromoacetophenone, m-bromo-tribromoacetophenone, or p-bromo-tribromoacetophenone, a sulfoxide containing plural halogens such as bis(trimromomethyl)sulfone, trichloromethylphenylsulfone, tribromomethylphenylsulfone, trichloromethyl-p-chlorophenylsulfone, tribromomethyl-p-nitrophenylsulfone, 2-trichloromethylbenzothiazolesulfone, or 2,4-dichlorophenyl-trichloromethylsulfone, and a pyrone compound, a triazine compound or an oxazole compound each containing plural halogens.

Examples of the onium salt or other photo-induced acid generating compound include an onium salt described in S. P. Papas et al., Polymn. Photochem. 5, 1, p. 104–115 (1984), a photo-induced acid generating agent represented by a diaryliodonium salt such as $Ph_2I^+/SbF_6^-$ described in "Shikizai", 66 (2), p. 104–115 (1994), a triarylsulfonium salt, a triarylselenonium salt, a dialkylphenacylsulfonium salt, a dialkyl-4-phenacylsulfonium salt, an α-hydroxymethylbenzoine sulfonic acid ester, an N-hydroxyiminosulfonate, an α-sufonyloxyketone, a β-sufonyloxyketone, an iron-arene complex (for example, benzene-cyclopentadienyl-iron (II)-hexafluorophosphate), an o-nitrobenzyl silyl ether compound, benzoine tosylate, and tri(nitrobenzyl)phosphate.

Besides the above compounds, there are ammonium salts, phosphonium salts, iodonium salts, sulfonium salts, selenium salts, arsonium salts, organic halides, o-nitrobenzyl derivatives, iminosulfonates and disulfone compounds.

Typical examples thereof include compounds represented by T-1 through T-15 described in Japanese Patent O.P.I. Publication No. 9-244226.

Among these, s-triazine compounds having two or more trihalogenomethyl groups are preferred and tris(trichloromethyl)-s-triazine is especially preferred. The content of the photo-induced acid generating agent is from 0.01 to 40% by weight, and preferably from 0.1 to 30% by weight, based on the total solid component of layers.

In the invention, examples of the compound changing its color by the action of an acid include dyes such as diphenylmethane dyes, triphenylmethane type thiazine dyes, thiazine dyes, oxazine dyes, xanthene dyes, anthraquinone dyes, iminonaphthoquinone dyes, azo dyes, and azomethine dyes.

Typical examples thereof include Briliant green, Ethyl violet, Methyl green, Crystal violet, Basic fuchsine, Methyl violet 2B, Quinardine red, Rose bengale, Metanil yellow, Thymolsulfophthalein, Xylenol blue, Methyl orange, Paramethyl red, Congo red, Benzopurpurin 4B, α-Naphthyl red, Nile blue 2B, Nile blue A, Methyl violet, Marachite green, Para-fuchsine, Victoria pure blue BOH (product of Hodogaya Kagaku), Oil blue #603 (product of Orient Kagaku kogyo), Oil pink #312 (product of Orient Kagaku kogyo), Oil red 5B product of Orient Kagaku kogyo), Oil scarlet #308 (product of Orient Kagaku kogyo), Oil red OG (product of Orient kagaku kogyo), Oil red RR (product of Orient kagaku kogyo), Oil green #502 (product of Orient kagaku kogyo), Spiron red BEH special (product of Hodogaya Kagaku), m-Cresol purple, Cresol red, Rhodamine B, Rhodamine 6G, Sulforhodamine B, Auramine, 4-p-diethylaminophenyliminonaphthoquinone, 2-carboxyanilino-4-p-diethylaminophenyliminonaphthoquinone, 2-carbostearylamino-4-p-dihydroxyethylamino-phenyliminonaphthoquinone, 1-phenyl-3-methyl-4-p-diethylaminophenylimino-5-pyrazolone and 1-β-naphthyl-4-p-diethylaminophenylimino-5-pyrazolone.

As the compound changing its color by the action of an acid, organic dyes such as aryl amines can be used. The aryl amines include leuco dyes as well as amines such as a primary aromatic amine and a secondary aromatic amine.

Examples thereof include diphenylamine, dibenzylaniline, triphenylamine, diethylaniline, diphenyl-p-phenylenediamine, p-toluidine, 4,4'-biphenyldiamine, o-chloroaniline, o-bromoaniline, 4-chloro-o-phenylenediamine, o-brom-N,N-dimethylaniline, 1,2,3-triphenylguanidine, naphthylamine, diaminodiphenylmethane, aniline, 2,5-dichloroaniline, N-methyldiphenylamine, o-toluidine, p,p'-tetramethyldiaminodiphenylmethane, N,N-dimethyl-p-phenylenediamine, 1,2-dianilinoethylene, p,p',p"-hexamethyltriaminotriphenylmethane, p,p'-tetramethyldiamino-triphenylmethane, p,p'-tetramethyldiaminodiphenylmethylimine, p,p',p"-triamino-o-methyltriphenylmethane, p,p',p"-triaminotriphenylcarbinol, p,p'-tetramethylaminodiphenyl-4-anilinonaphthylmethane, p,p',p"-triaminotriphenylmethane, and p,p',p"-hexapropyltriaminotriphenylmethane.

In the invention, an acidic substance used as an electron accepter in a thermal recording paper can be used as a color developing agent. Examples thereof include inorganic acids such as acidic china clay kaolin and zeolite, aromatic acids or anhydrides or metal salts thereof, and organic color developing agents such as organic sulfonic acids, other organic acids, phenol compounds, methylol derivatives of the phenol compounds, and salts or complexes of the phenol compounds. Among these, methylol derivatives of the phenol compounds, and salts of the phenol compounds (including complexes) are preferred.

Examples of the organic color developing agents include phenol compounds such as phenol, 4-phenylphenol, 4-hydroxyacetophenone, 2,2'-dihydroxydiphenyl, 2,2'-methylenebis(4-chlorophenol), 2,2'-methylenebis(4-methyl-6-t-butylphenol), 4,4'-isopropylidenediphenol (bisphenol A), 4,4'-isopropylidenebis(2-chlorophenol), 4,4'-isopropylidenebis (2-methylphenol), 4,4'-ethylenebis(2-methylphenol), 4,4'-thiobis(6-t-butyl-3-methylphenol), 1,1-bis(4-hydroxyphenyl)cyclohexanone, 2,2'-bis(4-hydroxyphenyl)-n-heptane, 4,4'-cyclohexylidenebis(2-isopropylphenol), and 4,4'-sulfonyldiphenyl, methylol derivatives of the phenol compounds, salts of the phenol compounds, salicylic acid anilide, novolak resins, benzyl p-hydroxybenzoate.

As the color forming agent used together with the color developing agent in the invention, there is a triphenylmethanelactone type leuco dye.

Examples of such a leuco dye include crystal violet lactone, 3-diethylamino-7-chlorofluoran, 3-diethylamino-6-methyl-7-chlorofluoran, 2-(N-phenyl-N-methylamino)-6-(N-p-Tolyl-N-ethyl)aminofluoran, malachite green lactone, 3,3-bis(1-ethyl-2-methylol-3-yl)phthalide, 3-diethylamino-6-methyl-7-anilinofluoran, 2-anilino-3-methyl-6-(N-ethyl-p-toluidino)fluoran, 3-(N-cyclohexyl-N-methylamino)-6-methyl-7-anilinofluoran, and 3-piperidino-6-methyl-7-anilinofluoran. Further, tris(4-dimethylaminophenyl) methane can be preferably used.

The content ratio by weight, color developing agent/color forming agent is preferably from 0.1/1 to 5/1, and more preferably from 0.5/1 to 3/1.

[Structural Layer of the Support Opposite the Image Formation Layer]

In the printing plate material of the invention, it is preferred that at least one structural layer is provided on the surface of the support opposite the image formation layer, in order to improve handling properties and minimize change in physical properties during storage. A preferred structural layer is a subbing layer, a hydrophilic binder-containing layer, or a hydrophobic binder-containing layer. The binder-containing layer may be provided on the subbing layer.

The subbing layer is preferably a subbing layer of the support described above.

The hydrophilic binder may be any as long as it exhibits hydrophilicity, and examples of the hydrophilic binder include resins having, as a hydrophilic group, a hydroxyl group such as polyvinyl alcohol (PVA), cellulose resins (methylcellulose MC, ethylcellulose EC, hydroxyethylcellulose HEC, carboxymethylcellulose CMC), chitins, or starch; resins having an ether bond such as polyethylene oxide PEO, polypropylene oxide PPO, polyethylene glycol PEG, or polyvinyl ether PVE; resins having an amide group or an amide bond such as polyacryl amide PAAM or polyvinyl pyrrolidone PVP; resins having as a dissociation group a carboxyl group such as polyacrylic acid salts, maleic acid resins, alginates or gelatins; polystyrene sulfonic acid salt; resins having an amino group, an imino group, a tertiary amino group or a quaternary ammonium group such as polyallylamine PAA, polyethylene imine PEI, epoxidated polyamide EPAM, polyvinyl pyridine or gelatins.

The hydrophobic binder may be any as long as it exhibits hydrophobicity, and examples of the hydrophobic binder include polymers derived from α,β-ethylenically unsaturated monomers such as polyvinyl chloride, chlorinated polyvinyl chloride, a copolymer of vinyl chloride and vinylidene chloride, a copolymer of vinyl chloride, and vinyl acetate, polyvinyl acetate, partially saponified polyvinyl acetate, polyvinyl acetal or preferably polyvinyl butyral in which a part of polyvinyl alcohol is acetalized with aldehyde, a copolymer of acrylonitrile and acryl amide, polyacrylates, polymethacrylates, polystyrene, polyethylene and a mixture thereof.

The hydrophobic binder may be water dispersible resins disclosed in Japanese Patent O.P.I. Publication No. 2002-258469, sections [0033] through [0038], as long as it can make the surface of the printing plate material hydrophobic.

It is preferred that the outermost structure layer contains a matting agent with an average particle size of from 1 μm to less than 20 μm, in order to easily mount the printing plate on a printing press and to prevent "out of color registration" due to "out of registration" of the printing plate during printing.

The matting agent is preferably inorganic particles having a new Mohs hardness of not less than 5 or an organic matting agent. Examples of the inorganic particles having a new Mohs hardness of not less than 5 include particles of metal oxides (for example, silica, alumina, titania, zirconia, iron oxides, chromium oxide), particles of metal carbides (for example, silicon carbide), boron nitride particles, and diamond particles. Examples of the organic matting agent include starch described in U.S. Pat. No. 2,322,037, starch derivatives described in BE 625,451 and GB 981,198, Polyvinyl alcohol described in JP-B-44-3643, polystyrene or polymethacrylate described in CH 330,158, polyacrylonitrile described in U.S. Pat. No. 3,079,257, and polycarbonate described in U.S. Pat. No. 3,022,169.

The adding amount of the matting agent in the overcoat layer is preferably from 0.1 g to less than 10 g per $m^2$.

The surface roughness of the structural layer of the support opposite the image formation layer can be adjusted by the particle size or addition amount of the matting agent or the content of the binder. The structural layer has a surface roughness Ra of preferably from 0.1 μm to less than 2 μm. The surface roughness less than 0.1 μm of the structural layer may result in poor transportability due to high coefficient of friction of the printing plate material or may cause any problem on mounting the printing plate material on a plate cylinder. The surface roughness more than 2 μm may scratch the surface of the support opposite the structural layer when the printing plate material is wound around a spool in its manufacturing process or another process, and may partially protrude the surface of the printing plate material due to such a coarse surface of the structural layer, resulting in poor printing durability due to excessive printing pressure applied to the protrusion portions.

A laser recording apparatus or a processless printing press has a sensor for controlling transportation of the printing plate material. In the invention, in order to carry out the controlling smoothly, the structural layer preferably contains dyes or pigment. The dyes or pigment are preferably infrared absorbing dyes or pigment as described above used as a light-to-heat conversion material. The structural layer can further contain a surfactant.

[Packaging Material]

The printing plate material manufactured above was cut into an intended size, packed in a packaging material and stored till the material is subjected to exposure for image formation as described later. In order to endure a long term storage, the packaging material is preferably one having an oxygen permeability of not more than 50 ml/atm $m^2$ 30° C.·day as disclosed in Japanese Patent O.P.I. Publication No. 2000-206653. As another embodiment, the packaging material is also preferred which has a moisture permeability of not more than 10 g/atm $m^2$ 20° C.·day as disclosed in Japanese Patent O.P.I. Publication No. 2000-206653.

[Exposure]

The present invention also provides a printing method which comprises the steps of forming an image on the printing plate material, employing a thermal head or a thermal laser, and removing the layer at non-image portions by development on press.

The image formation on the printing plate material of the invention is carried out by applying heat and can be carried out employing a thermal head used in a thermal printer, but is carried out preferably by thermal laser exposure.

Exposure applied in the invention is preferably scanning exposure, which is carried out employing a laser which can emit light having a wavelength of infrared and/or near-infrared regions, that is, a wavelength of from 700 to 1500 nm. As the laser, a gas laser can be used, but a semi-conductor laser, which emits light having a near-infrared region wavelength, is preferably used.

A device suitable for the scanning exposure in the invention may be any device capable of forming an image on the printing plate material according to image signals from a computer employing a semi-conductor laser.

Generally, the following scanning exposure processes are mentioned.

(1) A process in which a plate precursor provided on a fixed horizontal plate is scanning exposed in two dimensions, employing one or several laser beams.

(2) A process in which the surface of a plate precursor provided along the inner peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

(3) A process in which the surface of a plate precursor provided along the outer peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

In the invention, the process (3) above is preferable, and especially preferable when a printing plate material mounted on a plate cylinder of a printing press is scanning exposed.

Employing the thus printing plate material after image recording, printing is carried out without a special development process. After the printing plate material is imagewise exposed and mounted on a plate cylinder of a printing press, or after the printing plate material is mounted on the cylinder and then imagewise heated to obtain a printing plate material, a dampening water supply roller and/or an ink supply roller are brought into contact with the surface of the resulting printing plate material while rotating the plate cylinder to remove non-image portions of the component layer of the printing plate material (so-called, development on press).

The non-image portion removal after image recording as described above in the printing plate material of the invention can be carried out in the same sequences as in conventional PS plates. This means that processing time is shortened due to so-called development on press, resulting in lowering of cost.

It is preferred that the printing method of the invention comprises a step of drying a printing plate material, between the image recording (formation) step and a step of contacting a dampening water supply roller and/or an ink supply roller with the surface of the printing plate material. In the printing method of the invention, it is considered that the image strength gradually increases immediately after the image recording. As the conventional image recording method employing a conventional external thermal laser drum method (the process (3) above) requires about 3 minute exposure time, it has problem in that there is a difference in image strength between an image recorded at the beginning of the exposure and an image recorded at the completion of the exposure. The drying step described above can minimize such an image strength difference.

EXAMPLES

The present invention will be detailed employing the following examples, but the invention is not limited thereto.

Example 1

<<Preparation of Polyethylene Terephthalate Support>>

(Preparation of Support 1)

Employing terephthalic acid and ethylene glycol, polyethylene terephthalate having an intrinsic viscosity VI of 0.66 (at 25° C. in a phenol/tetrachloroethane (6/4 by weight) solvent) was prepared according to a conventional method. The resulting polyethylene terephthalate was formed into pellets, dried at 130° C. for 4 hours, and melted at 300° C. The melted polyethylene terephthalate was extruded from a T-shaped die onto a 50° C. drum, and rapidly cooled. Thus, an unstretched film sheet having an average thickness of 175 μm was obtained. The film sheet was stretched in the mechanical direction at 100° C. by a stretching magnification of 1.0, and then at 135° C. by a stretching magnification of 5.0. Successively, the stretched film sheet was further stretched at 100° C. by a stretching magnification of 6 in the transverse direction in a tenter. The resulting sheet was heat fixed at 240° C. for 20 seconds and relaxed at 240° C. in the transverse direction by 4%. Thereafter, the sheet at the chuck portions in the tenter was cut off, and the both edges in the transverse direction of the sheet were subjected to knurling treatment. The knurled sheet was cooled to 40° C., and wound around an up-take spool at a tension of 83.4 N/m. Thus, a biaxially stretched polyethylene terephthalate film sheet (support 1) was prepared. This polyethylene terephthalate film sheet had a glass transition temperature (Tg) of 79° C. The width of the polyethylene terephthalate film sheet had a width of 2.5 m.

(Preparation of Support 2)

Employing terephthalic acid and ethylene glycol, polyethylene terephthalate having an intrinsic viscosity VI of 0.66 (at 25° C. in a phenol/tetrachloroethane (6/4 by weight) solvent) was prepared according to a conventional method. The resulting polyethylene terephthalate was formed into pellets, dried at 130° C. for 4 hours, and melted at 300° C. The melted polyethylene terephthalate was extruded from a T-shaped die onto a 50° C. drum, and rapidly cooled. Thus, an unstretched film sheet having an average thickness of 175 μm was obtained. The film sheet was stretched in the mechanical direction at 102° C. by a stretching magnification of 1.3, and then at 110° C. by a stretching magnification of 2.6. Successively, the stretched film sheet was further stretched at 120° C. by a stretching magnification of 4.5 in the transverse direction in a tenter. The resulting sheet was heat fixed at 240° C. for 20 seconds and relaxed at 240° C. in the transverse direction by 4%. Thereafter, the sheet at the chuck portions in the tenter was cut off, and the both edges of the sheet were subjected to knurling treatment. The knurled sheet was cooled to 40° C., and wound around an up-take spool at a tension of 47.1 N/m. Thus, a biaxially stretched polyethylene terephthalate film sheet (support 2) was prepared. This polyethylene terephthalate film sheet had a glass transition temperature (Tg) of 79° C. The width of the polyethylene terephthalate film sheet had a width of 2.5 m.

The thickness dispersion of the supports 1 and 2 is shown in Table 4.

<<Preparation of Subbed Support>>

The both surfaces of the support prepared above were subjected to corona discharge treatment at 8 W/m$^2$ minute. Subsequently, the following subbing layer coating solution "a" was coated on one side of the support to give a subbing layer with a dry thickness of 0.8 μm, and further, the following subbing layer coating solution "b" was coated on the resulting layer, each being dried at 180° C. for 4 minutes. The surface of the thus obtained subbing layer was designated as subbing layer surface A. The following conductive layer coating solution and intermediate coating solution were coated in that order on the rear surface of the support opposite the subbing layer surface A, each being dried at 180° C. for 4 minutes, and the following subbing layer coating solution "c" was coated on the resulting layer, and dried at 180° C. for 4 minutes. The surface of the thus obtained subbing layer was designated as subbing layer surface B. The surface electric resistance of the resulting subbed support was $10^9$ Ω at 25° C. and 25% RH. The surface roughness of the subbing layer surface B was 0.8 μm in terms of Ra. The both subbing layers were subjected to plasma treatment under the conditions described later.

<Subbing layer coating solution a>

| | |
|---|---|
| PVdC polymer latex (Core-shell type latex containing particles comprised of 90% by weight of core and 10% by weight of shell, the core comprised of a copolymer of vinylidene chloride/methyl acrylate/methyl methacrylate/acrylonitrile/ | 3,000 parts by weight |

-continued

| | |
|---|---|
| acrylic acid {93/3/3/0.9/0.1 (% by weight) }, and the shell comprised of a copolymer of vinylidene chloride/methyl acrylate/methyl methacrylate/acrylonitrile/acrylic acid {88/3/3/3/3 (% by weight) }, the weight average molecular weight of the copolymer being 38,000) | |
| 2,4-Dichloro-6-hydroxy-s-triazine | 23 parts by weight |
| Matting agent (polystyrene, average particle size of 2.4 μm) | 1.5 parts by weight |
| Dye A | 1 part by weight |

Dye A

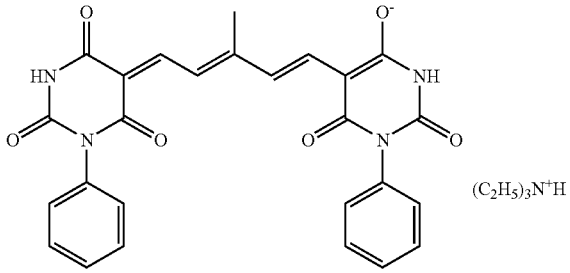

| | |
|---|---|
| <Subbing layer coating solution b> | |
| Alkali processed gelatin ($Ca^{+2}$ content: 30 ppm, jelly strength: 230 g) | 50 mg/m$^2$ |
| <Conductive layer coating solution> | |
| Julimer ET-410 (Tg = 52° C.) (produced by Nippon Junyaku Co., Ltd.) | 38 mg/m$^2$ |
| $SnO_2$/Sb (9/1 by weight) particles (average particle size: 0.25 μm) | 120 mg/m$^2$ |
| Matting agent polymethyl methacrylate (average particle size: 5 μm) | 7 mg/m$^2$ |
| Denacol EX-614B (produced by Nagase Kasei Kogyo Co., Ltd.) | 13 mg/m$^2$ |
| <Intermediate layer coating solution> | |
| Julimer ET-410 (Tg = 52° C.) (produced by Nippon Junyaku Co., Ltd.) | 38 mg/m$^2$ |
| <Subbing layer coating solution c> | |
| PVdC polymer latex (Core-shell type latex containing particles comprised of 90% by weight of core and 10% by weight of shell, the core comprised of a copolymer of vinylidene chloride/methyl acrylate/methyl methacrylate/acrylonitrile/acrylic acid {93/3/3/0.9/0.1 (% by weight) }, and the shell comprised of a copolymer of vinylidene chloride/methyl acrylate/methyl methacrylate/acrylonitrile/acrylic acid {88/3/3/3/3 (% by weight) }, the weight average molecular weight of the copolymer being 38,000) | 3,000 parts by weight |
| 2,4-Dichloro-6-hydroxy-s-triazine | 23 parts by weight |
| Matting agent (polystyrene, average particle size of 2.4 μm) | 1.5 parts by weight |

[Plasma Treatment]

The resulting subbed support was subjected to plasma treatment in the presence of a mixed gas of argon/nitrogen/hydrogen (90/5/5% by volume) at a high frequency output power of 4.5 kW and at a frequency of 5 kHz for 5 seconds, employing a batch type atmospheric pressure plasma treatment apparatus AP-1-H340 (produced by iishii kagaku Co., Ltd.).

<<Heat Treatment>>

The support was slit to obtain a width of 11.25 m, and subjected to heat treatment (low tension heat treatment) at a tension of 2 hPa at 180° C. for one minute.

<<Preparation of Printing Plate Material>>

The support 2 having a subbing layer was dried at 100° C. for 30 seconds, and covered with a moisture proof sheet so as not to contact moisture in air to obtain a covered support 2. The moisture content of the supports 1 and 2 was measured. The moisture content of the support 1 was 1.2%, and had that of the support 1 was 0.2%. The printing plate was prepared as follows. The covered support 2, immediately after uncovered, was coated with a hydrophilic layer.

A hydrophilic layer 1 coating solution shown in Table 1 (the preparation method will be described later), a hydrophilic layer 2 coating solution shown in Table 2 (the preparation method will be described later), and an image formation layer coating solution shown in Table 3 were coated on the subbing layer A of the resulting support with a wire bar. That is, the hydrophilic layer 1 coating solution and the hydrophilic layer 2 coating solution were coated on the subbing layer A in that order with a wire bar to give a dry thickness of 2.5 g/m$^2$ and 0.6 g/m$^2$, respectively, dried at 120° C. for 3 minutes, and further heat treated at 60° C. for 24 hours. Thereafter, the image formation layer shown in Table 3 was coated with a wire bar on the resulting hydrophilic layer to give a dry thickness of 0.6 g/m$^2$, dried at 50° C. for 3 minutes, and further subjected to seasoning treatment at 50° C. for 72 hours. Thus, a printing plate material was prepared.

[Preparation of Hydrophilic Layer 1 Coating Solution]

The materials as shown in Table 1 were sufficiently mixed in the amounts shown in Table 1 while stirring, employing a homogenizer, and filtered to obtain hydrophilic layer 1 coating solution. In Table 1, numerical values represent parts by weight.

TABLE 1

| Materials | Amount |
|---|---|
| Colloidal silica (alkali type): Snowtex XS (solid 20% by weight, produced by Nissan Kagaku Co., Ltd.) | 68 |
| STM-6500S produced by Nissan Kagaku Co., Ltd. (spherical particles comprised of melamine resin as cores and silica as shells with an average particle size of 6.5 μm and having a convexo-concave surface) | 2 |
| Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40% by weight (including 0.2% by weight of dispersant)} | 7 |
| Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight | 8 |
| Aqueous 4% by weight sodium carboxymethyl cellulose solution (Reagent produced by Kanto Kagaku Co., Ltd.) | 5 |
| Aqueous 10% by weight sodium phosphate dodecahydrate solution (Reagent produced by Kanto Kagaku Co., Ltd.) | 1 |
| Porous metal oxide particles Silton JC 40 (porous aluminosilicate particles having an average particle size of 4 μm, produced by Mizusawa Kagaku Co., Ltd.) | 4 |
| Pure water | 5 |

[Preparation of Hydrophilic Layer 2 Coating Solution]

The materials as shown in Table 2 were sufficiently-mixed in the amounts shown in Table 2 while stirring, employing a homogenizer, and filtered to obtain hydrophilic layer 1 coating solution. In Table 2, numerical values represent parts by weight.

TABLE 2

| Materials | Amount |
|---|---|
| Colloidal silica (alkali type): Snowtex S (solid 30% by weight, produced by Nissan Kagaku Co., Ltd.) | 17.3 |
| Necklace shaped colloidal silica (alkali type): Snowtex PSM (solid 20% by weight, produced by Nissan Kagaku Co., Ltd.) | 38.7 |
| STM-6500S produced by Nissan Kagaku Co., Ltd. (spherical particles comprised of melamine resin as cores and silica as shells with an average particle size of 6.5 μm and having a convexo-concave surface) | 1 |
| Cu—Fe—Mn type metal oxide black pigment: TM-3550 black aqueous dispersion {prepared by dispersing TM-3550 black powder having a particle size of 0.1 μm produced by Dainichi Seika Kogyo Co., Ltd. in water to give a solid content of 40% by weight (including 0.2% by weight of dispersant)} | 5 |
| Layer structural clay mineral particles: Montmorillonite Mineral Colloid MO gel prepared by vigorously stirring montmorillonite Mineral Colloid MO; gel produced by Southern Clay Products Co., Ltd. (average particle size: 0.1 μm) in water in a homogenizer to give a solid content of 5% by weight | 8 |
| Aqueous 4% by weight sodium carboxymethyl cellulose solution (Reagent produced by Kanto Kagaku Co., Ltd.) | 5 |
| Aqueous 10% by weight sodium phosphate dodecahydrate solution (Reagent produced by Kanto Kagaku Co., Ltd.) | 1 |
| Porous metal oxide particles Silton AMT 08 (porous aluminosilicate particles having an average particle size of 0.6 μm, produced by Mizusawa Kagaku Co., Ltd.) | 2.4 |
| Porous metal oxide particles Silton JC 20 (porous aluminosilicate particles having an average particle size of 2 μm, produced by Mizusawa Kagaku Co., Ltd.) | 2 |
| Porous metal oxide particles Silton JC 50 (porous aluminosilicate particles having an average particle size of 5 μm, produced by Mizusawa Kagaku Co., Ltd.) | 1 |
| Pure water | 19.6 |

[Preparation of image formation layer coating solution] The materials for the image formation layer coating solution are shown in Table 3. In Table 3, numerical values represent parts by weight.

TABLE 3

| Materials | Amount |
|---|---|
| Aqueous solution of sodium polyacrylate (average molecular weight: 50,000) AQUALIC DL453 (solid content 35%), produced by Nippon Shokubai Co., Ltd. | 24 |
| Carbodiimide (cross-linking agent) | 1 |
| Infrared dye | 1 |
| Matting agent Silica (average particle size: 3 μm, coefficiwent of variation: 25%) | 4 |
| Dispersion prepared by diluting with pure water carnauba wax emulsion A118 (having a solid content of 40% by weight, the wax having an average particle size of 0.3 μm, a melting viscosity at 140° C. of 8 cps, a softening point of 65° C., and a melting point of 80° C., producedby GifuCerac Co., Ltd.) to give a solid content of 5% by weight | 70 |
| Infrared dye | |

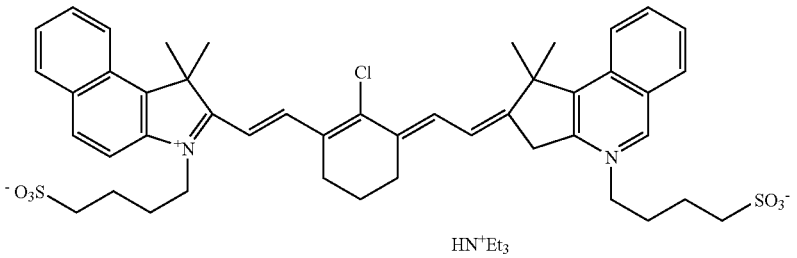

<<Preparation of Printing Plate Sample>>

The resulting printing plate material was cut into a size of 73 cm (width)×32 m (length), and wound around a spool made of cardboard having a diameter of 7.5 cm. Thus, a printing plate sample in roll form was prepared. The resulting printing plate sample was wrapped in a 150 cm×2 m package made of Al203PET (12 μm)/Ny (15 μm)/CPP (70 μm). The resulting wrapped material was stored at 60° C. and 60% RH for seven days. The package had an oxygen permeation of 1.7 ml/atm $m^2$ 30° C.·day, and a moisture permeability of 1.8 g/atm $m^2$ 25° C.·day.

Two lots of the printing plate sample employing support 1 were prepared.

<<Evaluation of Printing Plate Sample>>

(a) Image Formation Employing Infrared Laser

The resulting printing plate sample was cut so as to suit an exposure device, wound around an exposure drum of the exposure device and imagewise exposed. Exposure was carried out employing an infrared laser (having a wavelength of 830 nm and a laser beam spot diameter of 18 μm) at a resolution of 2400 dpi to form an image with a screen number of 175 lines. In the exposure, the exposure energy on the image formation layer surface was varied from 150 to 350 mJ/$cm^2$ at an interval of 50 mJ/$cm^2$. The term, "dpi" shows the number of dots per 2.54 cm. Thus, an exposed printing plate sample with an image was obtained.

(b) Folding Test of Printing Plate Sample

The exposed printing plate sample obtained above was folded employing a folding apparatus as shown in FIG. 1. The exposed printing plate sample having support 1 was folded without heating to obtain sample 101. The exposed printing plate sample having support 1 was folded at 80° C. in 16 seconds to obtain sample 102. The exposed printing plate sample having support 2 was folded at 80° C. in 16 seconds to obtain sample 103.

(C) Evaluation as Printing Plate

<<Printing Method>>

(Printing Method)

The folded sample obtained above was mounted on a printing press, SPEED MASTER SM-74 produced by Heiderberg Co., Ltd., and then printing was carried out employing a coated paper, dampening water a 2% by weight solution of Astromark 3 (produced by Nikken Kagaku Kenkyusyo Co., Ltd.), and printing ink (Toyo King Hyecho M Magenta, produced by Toyo Ink Manufacturing Co.). Printing was carried out in the same manner as in printing sequence carried out for a conventional PS plate, except that development employing a special developer was not carried out. After 10 copies were printed, the surface of the sample was observed and layers at non-image portions of the inventive printing plate samples were eliminated.

<<Dimensional Stability>>

The exposed sample was scratched to form two grooves with a width of 50 μm, one being 50 cm distant from the other. Printing was carried out employing the sample, the distance between the two grooves on the one hundredth printed sheet and thirty thousandth printed sheet was observed. The less the difference is the better.

<<Ink Receptivity>>

After 1000 copies were printed, ink supply was stopped and dampening water alone was supplied to the sample for 5 minutes. After that, the number of paper sheets printed from when printing restarted till when an image with a normal ink density was printed was counted. The less the number is, the better the ink receptivity.

<<Printing Durability>>

Printing durability was expressed in terms of the number of paper sheets printed from when printing started till when a 3% dot image lacked not less than 50% of the dots was counted. The more the number is, the higher the printing durability. The results are shown in Table 4.

TABLE 4

| Sample No. | Support No. used | Thickness dispersion of support used (%) | Heating at folding test | Dimensional stability (μm) | Ink receptivity (number) | Printing durability (number) | Remarks |
|---|---|---|---|---|---|---|---|
| 101 | 1 | 13 | None | 200 | 100 | 1000 | Comp. |
| 102 | 1 | 13 | Yes | 250 | 80 | 1000 | Comp. |
| 103 | 2 | 3 | Yes | 50 | 8 | Not less than 20,000 | Inv. |

Comp.: Comparative,
Inv: Inventive

In FIG. 1, numerical number 1 represents a V-shaped groove, numerical number 2 represents a base line, numerical number 3 represents a pedestal, and numerical number 4 represents a protective tape.

Figure 2:
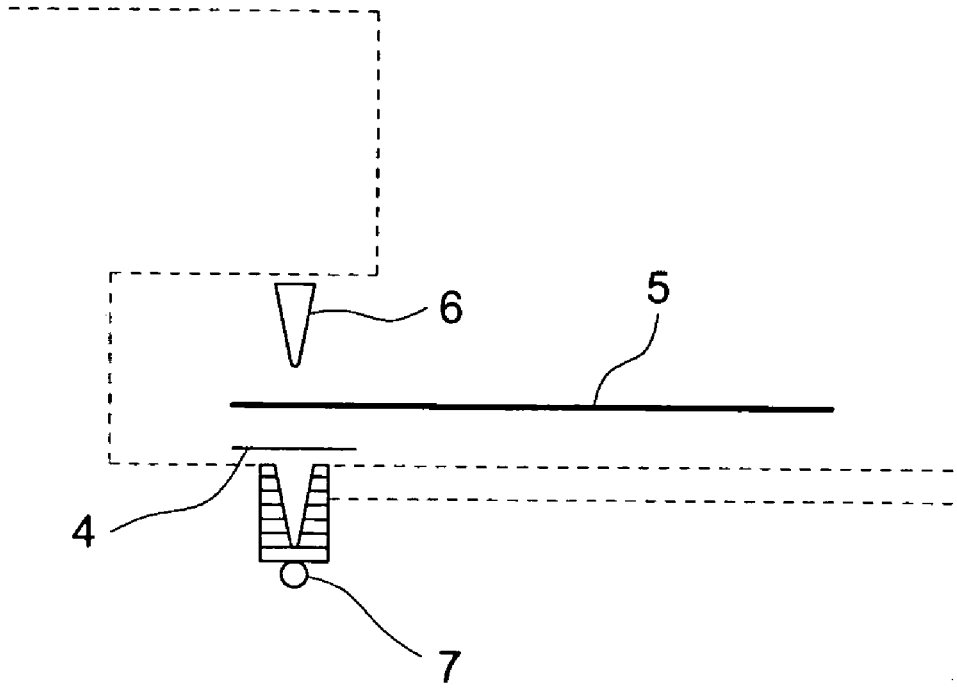
FIG. 2 shows a sectional view of a blade, a heater section and a protective sheet of a folding apparatus.

FIG. 2 shows a partial sectional view of a folding apparatus comprising a blade, a heater section and a protective sheet.

In FIG. 2, numerical number 4 represents a protective tape, numerical number 5 represents a printing plate material, numerical number 6 represents a blade, and numerical number 7 represents a heater.

As is apparent from Table 4, inventive sample 103 provides excellent dimensional stability, good ink receptivity and high printing durability, as compared with comparative samples 101 and 102.

Example 2

<<Preparation of Printing Plate Sample>>

The hydrophilic layer 1, the hydrophilic layer 2 and the image formation layer were coated on the subbing layer A of the support 2 in the same manner as in Example 1. Subsequently, an overcoat layer coating solution having the following composition was coated on the resulting image formation layer of the material with a wire bar to give a dry thickness of 0.4 g/m$^2$, and dried at 50° C. for 3 minutes. Thereafter, a backing layer coating solution having the following composition was coated on the subbing layer B of the support 2 with a wire bar to give a dry thickness of 1.5 g/m$^2$, and dried at 50° C. for 20 minutes. The resulting material was further subjected to seasoning treatment at 50° C. for 24 hours, and to humidity conditioning at 23° C. and 20% RH for 24 hours. Thus, a printing plate material having an overcoat layer was prepared.

| [Overcoat layer coating solution] | |
|---|---|
| Polyvinyl acetate having a degree of saponification of 98% (weight average molecular weight: 200,000) | 15 parts by weight |
| Hexamethylene diisocyanate | 1 part by weight |
| Matting agent (amorphous silica, Average particle size: 2 μm) | 2 parts by weight |
| Water | 82 parts by weight |
| [Backing layer coating solution] | |
| Polyacrylic acid (Julimer AC-10H produced by Nippon Junyaku Co., Ltd., average molecular weight: 200,000, water soluble resin) | 16 parts by weight |
| Carbodiimide (cross-linking agent) | 2 parts by weight |
| Matting agent (amorphous silica, Average particle size: 3.5 μm) | 2 parts by weight |
| Water | 80 parts by weight |

The surface roughness of the backing layer was 0.9 μm in terms of Ra.

The resulting printing plate material was treated in the same manner as in Example 1. The printing plate material was cut into a size of 73 cm (width)×32 m (length), and wound around a spool made of cardboard having a diameter of 7.5 cm. Thus, a printing plate sample in roll form was prepared. The resulting printing plate sample was wrapped in a 150 cm×2 m package made of Al203PET (12 μm)/Ny (15 μm)/CPP (70 μm). The wrapped material was stored at 60° C. and 60% RH for seven days. The package had an oxygen permeation of 1.7 ml/atm-m$^2$-30° C.·day, and a moisture permeability of 1.8 g/atm-m$^2$-25° C.·day.

The resulting printing plate sample was exposed for image formation in the same manner as in Example 1. The exposed printing plate sample was folded in the same manner as Sample 103 of Example 1 to obtain sample 203. Employing sample 3, printing was carried out in the same manner as in Example 1, and the same evaluation as Example 1 was carried out, except for printing durability. Herein, printing durability was expressed in terms of the number of paper sheet printed from when printing started till when density unevenness was produced at solid image portions was counted. (Fifty thousand copies were printed). The results are shown in Table 5.

TABLE 5

| Sample No. | Support No. used | Thickness dispersion of support used (%) | Heating at folding test | Dimensional stability (μm) | Ink receptivity (number) | Printing durability (number) | Remarks |
|---|---|---|---|---|---|---|---|
| 203 | 2 | 3 | Yes | 50 | 7 | Not less than 50,000 | Inv. |

Inv: Inventive

As is apparent from Table 5, Sample 203, which is inventive printing plate material comprising an overcoat layer provides excellent dimensional stability, good ink receptivity, and high printing durability.

Example 3

An anti-static layer containing a conductive carbon (gelatin content: 0.8 g/m$^2$) and a back coating layer containing 0.2 g/m$^2$ of silica particles with an average particles size of 4 μm (SY 378, produced by Fuji Silysia Chemical Co., Ltd.) (gelatin content: 2 g/m$^2$) were provided on one side (rear surface) of each of the supports 1 and 2 in that order. Subsequently, the other side (front surface) of each support was subjected to corona discharge treatment. A subbing layer containing carbon black and silica particles with an average particles size of 4 μm (SY 378, produced by Fuji Silysia Chemical Co., Ltd.) (gelatin content: 3.5 g/m$^2$) and a red sensitive silver chloride emulsion layer with highly sensitivity containing silver in terms of silver nitrate (gelatin content: 0.8 g/M$^2$) were simultaneously coated on the corona discharged surface, the latter being provided on the former, and dried at 40° C. for 7 days. Further, a physical developing nucleus layer coating solution, in which 5 mg/m$^2$ of Polymer P-2 described in Japanese Patent O.P.I. Publication No. 8-21164 were added to a physical developing nucleus-containing coating solution described in Example 2 of Japanese Patent O.P.I. Publication No. 53-21602 (containing an acryl amide-vinyl imidazole copolymer No.3 as a polymer and 0.8 g/m$^2$ of hydroquinone as a developing agent), was coated on the resulting emulsion layer and dried. Thus, a planographic printing plate material for scanning exposure was prepared.

The resulting printing plate material was treated in the same manner as in Example 1. The printing plate material was cut into a size of 73 cm (width)×32 m (length), and wound around a spool made of cardboard having a diameter of 7.5 cm. Thus, a printing plate sample in roll form was prepared. The resulting printing plate sample was wrapped in a 150 cm×2 m package made of Al203PET (12 μm)/Ny (15 μm)/CPP (70 μm). The resulting wrapped material was stored at 60° C. and 60% RH for seven days. The package had an oxygen permeation of 1.7 ml/atm m$^2$ 30° C.·day, and a moisture permeability of 1.8 g/atm m$^2$ 25° C.·day.

Two lots of the printing plate sample employing support 1 were prepared.

Employing SDP-Eco 1630 provided with a scanning exposure device, a helium-neon laser produced by Mitsubishi Seishi Co., Ltd. and with a developing processor, the resulting printing plate material was scanning exposed at a resolution of 2400 dpi at a screen number of 175 lines, and developed with a developer to obtain a printing plate sample with an image. Developer SLM-EAC as the developer and a stabilizing solution SLM-EST, each produced by Mitsubishi Seishi Co., Ltd., were used.

The exposed printing plate sample was folded in the same manner as in Example 1 employing the folding apparatus. The exposed printing plate sample having support 1 was folded without heating to obtain Sample 301. The exposed printing plate sample having support 1 was folded at 80° C. in 16 seconds to obtain Sample 302. The exposed printing plate sample having support 2 was folded at 80° C. in 16 seconds to obtain Sample 303. Employing the resulting samples, printing was carried out in the same manner as in Example 1, and the same evaluation as Example 1 was carried out. The results are shown in Table 6.

TABLE 6

| Sample No. | Support No. used | Thickness dispersion of support used (%) | Heating at folding test | Dimensional stability (μm) | Ink receptivity (number) | Printing durability (number) | Remarks |
|---|---|---|---|---|---|---|---|
| 301 | 1 | 13 | None | 210 | 100 | 1,000 | Comp. |
| 302 | 1 | 13 | Yes | 280 | 90 | 1,000 | Comp. |
| 303 | 2 | 3 | Yes | 80 | 20 | 8,000 | Inv. |

Comp.: Comparative,
Inv: Inventive

As is apparent from Table 6, Inventive sample 303 provides excellent dimensional stability, good ink receptivity, and high printing durability.

EFFECT OF THE INVENTION

The present invention provides a printing plate material capable of being folded by heating, which employs a plastic film sheet support, providing high printing durability, good ink receptivity and excellent dimensional stability; a printing process employing the printing plate material; and a process of folding the printing plate material.

What is claimed is:

1. A printing plate material comprising a support and provided thereon, an image formation layer, the support being a polyester film sheet with a thickness dispersion of not more than 10% and the support having a water content of not more than 0.5% by weight, wherein the printing plate material is capable of being folded by heating.

2. The printing plate material of claim 1, wherein the support has an average thickness of from 80 to 400 μm.

3. The printing plate material of claim 1, wherein the image formation layer contains heat melting particles or heat fusible particles.

4. The printing plate material of claim 1, wherein one or more hydrophilic layers are provided between the support and the image formation layer.

5. The printing plate material of claim 4, wherein at least one of the hydrophilic layers has a porous structure.

6. The printing plate material of claim 1, further comprising a layer containing a light-to-heat conversion material.

7. A process of printing comprising the steps of:

(a) forming an image on a printing plate material capable of being folded by heating comprising a support and provided thereon, an image formation layer, the support being a polyester film sheet with a thickness dispersion of not more than 10% and the support having a water content of not more than 0.5% by weight, and the material being not subjected to wet development;

(b) folding the resulting printing plate material at the edge portion by heating;

(c) mounting the folded printing plate material on a plate cylinder of a printing press; and (d) removing the image formation layer at non-image portions of the printing plate material mounted on the plate cylinder.

8. The process of claim 7, wherein the image formation is carried out employing a thermal head or a thermal laser.

9. The process of claim 7, wherein the removing is carried out supplying dampening water and/or printing ink to the printing plate material.

10. The process of claim 7, wherein the support has an average thickness of from 80 to 400 μm.

11. The process of claim 7, wherein the image formation layer contains heat melting particles or heat fusible particles.

12. The process of claim 7, wherein one or more hydrophilic layers are provided between the support and the image formation layer.

13. The process of claim 12, wherein at least one of the hydrophilic layers has a porous structure.

14. The process of claim 7, wherein further comprising a layer containing a light-to-heat conversion material.

15. A process of folding a printing plate material comprising a support and provided thereon, an image formation layer, the support being a polyester film sheet with a thickness dispersion of not more than 10% and the support having a water content of not more than 0.5% by weight, the process comprising the steps of:

folding the printing plate material at the edge portion by heating.

16. The process of claim 15, wherein the support has an average thickness of from 80 to 400 μm.

17. The process of claim 15, wherein the image formation layer contains heat melting particles or heat fusible particles.

18. The process of claim 15, wherein one or more hydrophilic layers are provided between the support and the image formation layer.

19. The process of claim 18, wherein at least one of the hydrophilic layers has a porous structure.

20. The process of claim 15, wherein further comprising a layer containing a light-to-heat conversion material.

* * * * *